US010176813B2

(12) United States Patent
Melkote et al.

(10) Patent No.: US 10,176,813 B2
(45) Date of Patent: Jan. 8, 2019

(54) AUDIO ENCODING AND RENDERING WITH DISCONTINUITY COMPENSATION

(71) Applicant: DOLBY LABORATORIES LICENSING CORPORATION, San Francisco, CA (US)

(72) Inventors: Vinay Melkote, Bangalore (IN); David S. McGrath, McMahons Point (AU)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 15/566,200

(22) PCT Filed: Apr. 14, 2016

(86) PCT No.: PCT/US2016/027448

§ 371 (c)(1),
(2) Date: Oct. 12, 2017

(87) PCT Pub. No.: WO2016/168408

PCT Pub. Date: Oct. 20, 2016

(65) Prior Publication Data

US 2018/0122384 A1 May 3, 2018

Related U.S. Application Data

(60) Provisional application No. 62/128,835, filed on Apr. 17, 2015.

(51) Int. Cl.

| | |
|---|---|
| ***H04S 3/00*** | (2006.01) |
| ***G10L 19/00*** | (2013.01) |
| ***G10L 19/008*** | (2013.01) |

(52) U.S. Cl.
CPC ..... *G10L 19/008* (2013.01); *G10L 19/0017* (2013.01); *H04S 3/008* (2013.01); *H04S 2400/01* (2013.01); *H04S 2400/11* (2013.01)

(58) Field of Classification Search
None
See application file for complete search history.

(56) References Cited

U.S. PATENT DOCUMENTS

| | | | |
|---|---|---|---|
| 5,408,580 | A | 4/1995 | Stautner |
| 6,085,031 | A | 7/2000 | Johnson |

(Continued)

FOREIGN PATENT DOCUMENTS

| | | |
|---|---|---|
| WO | 2011/119401 | 9/2011 |
| WO | 2012/136380 | 10/2012 |

(Continued)

OTHER PUBLICATIONS

Kim, K. et al "Spatial Audio Object Coding with Two-Step Coding Structure for Interactive Audio Service" IEEE Transactions on Multimedia, vol. 13, Issue 6, Sep. 15, 2011.

(Continued)

*Primary Examiner* — Curtis Kuntz
*Assistant Examiner* — Qin Zhu

(57) ABSTRACT

Methods for generating encoded audio programs indicative of N channels of discontinuity-corrected, encoded audio content, including by applying discontinuity correction values to multi-channel audio content, and for rendering such a program (e.g., to generate a discontinuity-corrected M-channel mix of content indicated by the program). Other aspects are systems or devices (e.g., encoders or decoders, or rendering systems) configured to implement any of the methods.

20 Claims, 5 Drawing Sheets

(56) References Cited

U.S. PATENT DOCUMENTS

| | | | | |
|---|---|---|---|---|
| 6,110,113 | A | 8/2000 | Banjamin | |
| 6,611,212 | B1 | 8/2003 | Craven | |
| 9,794,712 | B2 | 10/2017 | Melkote | |
| 9,826,327 | B2 | 11/2017 | Law | |
| 2003/0115051 | A1 | 6/2003 | Chen | |
| 2004/0044520 | A1 | 3/2004 | Chen | |
| 2008/0232601 | A1 | 9/2008 | Pulkki | |
| 2009/0125313 | A1 | 5/2009 | Hellmuth | |
| 2011/0246139 | A1* | 10/2011 | Kishi | G10L 19/008 702/189 |
| 2011/0255714 | A1 | 10/2011 | Neusinger | |
| 2012/0114126 | A1 | 5/2012 | Thiergart | |
| 2012/0230497 | A1 | 9/2012 | Dressler | |
| 2014/0119551 | A1 | 5/2014 | Bharitkar | |
| 2014/0226823 | A1* | 8/2014 | Sen | G10L 19/167 381/17 |
| 2014/0241528 | A1 | 8/2014 | Gunawan | |
| 2016/0142844 | A1* | 5/2016 | Breebaart | H04S 7/30 381/23 |
| 2016/0241981 | A1* | 8/2016 | Law | G10L 19/008 |
| 2017/0047071 | A1 | 2/2017 | Melkote | |

FOREIGN PATENT DOCUMENTS

| | | |
|---|---|---|
| WO | 2013/192111 | 12/2013 |
| WO | 2014/209902 | 12/2014 |
| WO | 2015/048387 | 4/2015 |

OTHER PUBLICATIONS

Park, J. et al "Harmonic Elimination Structures for Karaoke Mode in Spatial Audio Object Coding Scheme" IEEE International Conference on Consumer Electronics, Jan. 9-12, 2011, pp. 813-814.

Gerzon, M. et al "The MLP Lossless Compression System for PCM Audio" JAES vol. 52, Issue 3 pp. 243-260, Mar. 15, 2004.

* cited by examiner

FIG. 2

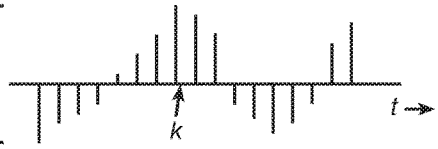

Samples of the rendered signal when the rendering matrix does not change at time t = k, i.e., $\mathbf{A}(k) = \mathbf{A}(k-1)$

FIG. 3

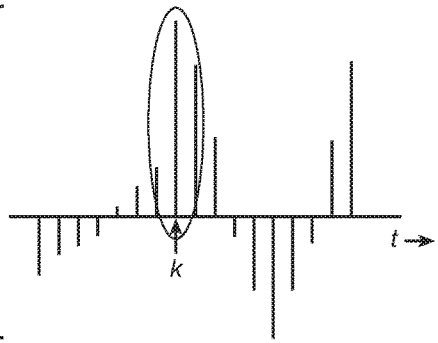

It is desired that the matrix be updated at time t = k, i.e., $\mathbf{A}(k) \neq \mathbf{A}(k-1)$ The abrupt change in the matrix results in a discontinuity in the rendered signal,

FIG. 4

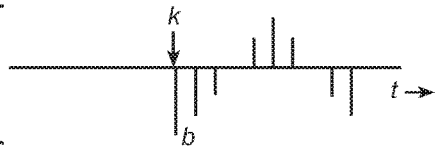

There is a zeroth order discontinuity of magnitude "b"

FIG. 5

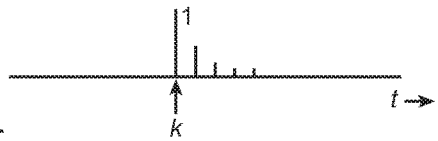

Prototype correction signal for zeroth order discontinuity: Exponentially decaying signal starting with a sample of unit magnitude

FIG. 6

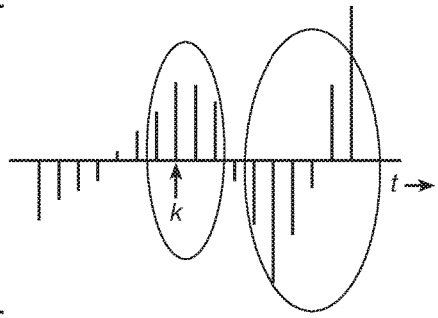

Corrected signal:

AUDIO ENCODING AND RENDERING WITH DISCONTINUITY COMPENSATION

CROSS-REFERENCE TO RELATED APPLICATIONS

This application claims the benefit of U.S. Provisional Patent Application No. 62/148,835, filed Apr. 17, 2015, hereby incorporated by reference in its entirety.

TECHNICAL FIELD

The invention pertains to audio signal processing, and more particularly to encoding, decoding, and rendering of multichannel audio programs (e.g., bitstreams indicative of object-based audio programs including at least one audio object channel and at least one speaker channel) using a sequence of rendering matrices. In some embodiments, in response to an update of a rendering matrix (e.g., in response to each transition between consecutive rendering matrices of a sequence of rendering matrices), a set of correction values is determined for use (i.e., application to audio data during encoding and/or rendering) to compensate for at least one discontinuity that would otherwise result (i.e., if the compensation were not performed) from the update during rendering (after encoding and decoding) of the audio data. Some embodiments generate, decode, and/or render audio data in the format known as Dolby TrueHD.

BACKGROUND

Dolby, Dolby TrueHD, and Atmos are trademarks of Dolby Laboratories Licensing Corporation.

The complexity, and financial and computational cost, of rendering audio programs increases with the number of channels to be rendered. During rendering and playback of object based audio programs, the audio content has a number of channels (e.g., object channels and speaker channels) which is typically much larger (e.g., by an order of magnitude) than the number occurring during rendering and playback of conventional speaker-channel based programs. Typically also, the speaker system used for playback includes a much larger number of speakers than the number employed for playback of conventional speaker-channel based programs.

Although embodiments of the invention are useful for rendering channels of any multichannel audio program, many embodiments of the invention are especially useful for rendering channels of object-based audio programs having a large number of channels.

It is known to employ playback systems (e.g., in movie theaters) to render object based audio programs. Object based audio programs may be indicative of many different audio objects corresponding to images on a screen, dialog, noises, and sound effects that emanate from different places on (or relative to) the screen, as well as background music and ambient effects (which may be indicated by speaker channels of the program) to create the intended overall auditory experience. Accurate playback of such programs requires that sounds be reproduced in a way that corresponds as closely as possible to what is intended by the content creator with respect to audio object size, position, intensity, movement, and depth.

During generation of object based audio programs, it is typically assumed that the loudspeakers to be employed for rendering are located in arbitrary locations in the playback environment; not necessarily in a predetermined arrangement in a (nominally) horizontal plane or in any other predetermined arrangement known at the time of program generation. Typically, metadata included in the program indicates rendering parameters for rendering at least one object of the program at an apparent spatial location or along a trajectory (in a three dimensional volume), e.g., using a three-dimensional array of speakers. For example, an object channel of the program may have corresponding metadata indicating a three-dimensional trajectory of apparent spatial positions at which the object (indicated by the object channel) is to be rendered. The trajectory may include a sequence of "floor" locations (in the plane of a subset of speakers which are assumed to be located on the floor, or in another horizontal plane, of the playback environment), and a sequence of "above-floor" locations (each determined by driving a subset of the speakers which are assumed to be located in at least one other horizontal plane of the playback environment).

Object based audio programs represent a significant improvement in many respects over traditional speaker channel-based audio programs, since speaker-channel based audio is more limited with respect to spatial playback of specific audio objects than is object channel based audio. Speaker channel-based audio programs consist of speaker channels only (not object channels), and each speaker channel typically determines a speaker feed for a specific, individual speaker in a listening environment.

Various methods and systems for generating and rendering object based audio programs have been proposed. Examples of rendering of object based audio programs are described, for example, in PCT International Application No. PCT/US2011/028783, published under International Publication No. WO 2011/119401 A2 on Sep. 29, 2011, and assigned to the assignee of the present application.

An object-based audio program may include "bed" channels. A bed channel may be an object channel indicative of an object whose position does not change over the relevant time interval (and so is typically rendered using a set of playback system speakers having static speaker locations), or it may be a speaker channel (to be rendered by a specific speaker of a playback system). Bed channels do not have corresponding time varying position metadata (though they may be considered to have time-invariant position metadata). They may by indicative of audio elements that are dispersed in space, for instance, audio indicative of ambience.

Professional and consumer-level audio-visual (AV) systems (e.g., the Dolby® Atmos™ system) have been developed to render hybrid audio content of object-based audio programs that include both bed channels and object channels that are not bed channels.

Playback of an object-based audio program over a traditional speaker set-up (e.g., a 7.1 playback system) is achieved by rendering channels of the program (including object channels) to a set of speaker feeds. In typical embodiments of the invention, the process of rendering object channels (sometimes referred to herein as objects) and other channels of an object-based audio program (or channels of an audio program of another type) comprises in large part (or solely) a conversion of spatial metadata (for the channels to be rendered) at each time instant into a corresponding gain matrix (referred to herein as a "rendering matrix") which represents how much each of the channels (e.g., object channels and speaker channels) contributes to a mix of audio content (at the instant) indicated by the speaker feed for a particular speaker (i.e., the relative weight of each of the channels of the program in the mix indicated by the speaker feed).

An "object channel" of an object-based audio program is indicative of a sequence of samples indicative of an audio object, and the program typically includes a sequence of spatial position metadata values indicative of object position or trajectory for each object channel. In typical embodiments of the invention, sequences of metadata values (e.g., position metadata values) corresponding to a number (N) of object channels (and/or speaker channels) of a program are used to determine an M×N rendering matrix, A(t), indicative of a time-varying gain specification for the program, and the rendering matrix is applied to render the channels for playback by a number ("M") of speakers.

Rendering of "N" channels (e.g., object channels, or object channels and speaker channels, or speaker channels which may but need not be indicative of mixed and otherwise processed content of a greater number of object channels) of an audio program to "M" speakers (speaker feeds) at time "t" of the program can be represented by multiplication of a vector x(t) of length "N" (i.e., an N×1 matrix, x(t)), comprised of an audio sample at time "t" from each channel, by an M×N matrix A(t) determined from associated metadata (e.g., position metadata and optionally other metadata corresponding to the audio content to be rendered, e.g., object gains) at time "t". The resultant values (e.g., gains or levels) of the speaker feeds at time t can be represented as a vector y(t), as in the following equation (1):

$$\underbrace{\begin{bmatrix} y_0(t) \\ y_1(t) \\ \vdots \\ y_{M-1}(t) \end{bmatrix}}_{y(t)} = \underbrace{\begin{bmatrix} a_{00}(t) & a_{01}(t) & a_{02}(t) & \ddots & a_{0,N-1}(t) \\ a_{10}(t) & \ddots & \ddots & \ddots & \ddots \\ \ddots & \ddots & \ddots & \ddots & \ddots \\ a_{M-1,0}(t) & \ddots & \ddots & \ddots & a_{M-1,N-1}(t) \end{bmatrix}}_{A(t)} \underbrace{\begin{bmatrix} x_0(t) \\ x_1(t) \\ x_2(t) \\ \vdots \\ x_{N-1}(t) \end{bmatrix}}_{x(t)}. \quad (1)$$

Although equation (1) describes the rendering of N channels of an audio program (e.g., an object-based audio program, or an encoded version of an object-based audio program) into M output channels (e.g., M speaker feeds), it also represents a generic set of scenarios in which a set of N audio samples is converted to a set of M values (e.g., M samples) by linear operations. For example, A(t) could be a static matrix, "A", whose coefficients do not vary with different values of time "t". For another example, A(t) (which could be a static matrix, A) could represent a conventional downmix of a set of speaker channels x(t) to a smaller set of speaker channels y(t), or x(t) could be a set of audio channels that describe a spatial scene in an Ambisonics format, and the conversion to speaker feeds y(t) could be prescribed as multiplication by the rendering matrix A(t). In this context, the M×N rendering matrix is sometimes referred to as a "downmix matrix" (although in general, M need not satisfy M<N in equation (1)). Even in an application employing a nominally static downmix matrix, the actual linear transformation (matrix multiplication) applied may be dynamic in order to ensure clip-protection of the downmix (i.e., a static transformation A may be converted to a time-varying transformation A(t), to ensure clip-protection).

Dolby TrueHD is a conventional audio codec format that supports lossless and scalable transmission of audio signals. The source audio is encoded into a hierarchy of substreams of channels, and a selected subset of the substreams (rather than all of the substreams) may be retrieved from the bitstream and decoded, in order to obtain a lower dimensional (downmix) presentation of the spatial scene. Typically, when all the substreams (sometimes referred to herein collectively as a "top" substream) are decoded and rendered, the resultant audio is identical to the source audio (i.e., the encoding, followed by the decoding, is lossless).

In a commercially available version of TrueHD, the source audio is typically a 7.1 channel mix which is encoded into a sequence of three substreams, including a first substream which can be decoded to determine a two channel downmix of the 7.1 channel original audio. The first two substreams may be decoded to determine a 5.1 channel downmix of the original audio. All three substreams (i.e., a top substream of the encoded bitstream) may be decoded to determine the original 7.1 channel audio. Technical details of Dolby TrueHD, and the Meridian Lossless Packing (MLP) technology on which it is based, are well known. Aspects of TrueHD and MLP technology are described in U.S. Pat. No. 6,611,212, issued Aug. 26, 2003, and assigned to Dolby Laboratories Licensing Corp., and the paper by Gerzon, et al., entitled "The MLP Lossless Compression System for PCM Audio," J. AES, Vol. 52, No. 3, pp. 243-260 (March 2004).

TrueHD supports specification of downmix matrices. In typical use, the content creator of a 7.1 channel audio program specifies a static matrix to downmix the 7.1 channel program to a 5.1 channel mix, and another static matrix to downmix the 5.1 channel downmix to a 2 channel downmix. Each static downmix matrix may be converted to a sequence of downmix matrices (each matrix in the sequence for downmixing a different interval in the program) in order to achieve clip-protection.

A program encoded in accordance with the Dolby TrueHD format may be indicative of N channels (e.g., N object channels) and also at least one downmix presentation. Each downmix presentation comprises M downmix channels (where, in this context, M is an integer less than N), and its audio content is a mix of audio content of all or some of the content of the N channels. The program (as delivered to a decoder) includes internally coded channels, and metadata indicative of matrix operations to be performed by a decoder on all or some of the internally coded channels. Some such matrix operations are performed by the decoder on all the internally coded channels such that combined operation of both the encoder and decoder implements a multiplication by a matrix A(t) (of the type indicated in equation (1)) on the full set of N channels (corresponding to the vector x(t) of equation (1)). Other ones of such matrix operations are performed by the decoder on a subset of the internally coded channels such that combined operation of both the encoder and decoder implements a multiplication by an M×N matrix A(t) (of the type indicated in equation (1), where M is less than N, and N is the number of channels in the full set of input channels) on the original N input channels.

A legacy device (e.g., a device configured to decode and render at least one downmix presentation embedded in a TrueHD program instead of decoding and rendering (e.g., losslessly) the full set of N channels indicated by the program, which may be N object channels) may in fact be an older device that is unable to decode and render the full set of N channels (e.g., object channels) indicated by the program, or it may be another device configured (e.g., to implement a conscious choice by a user) to decode and render at least one such downmix presentation. Legacy content of a TrueHD bitstream may be characterized by a well-structured time-invariant downmix matrix (e.g., a standard 7.1 ch to 5.1 ch downmix matrix). In such a case, the metadata (included in the TrueHD bitstream by the encoder) indicative of a matrix operation to be implemented by a legacy decoder to render a downmix presentation needs to be determined only once by the encoder for the entire audio signal. Alternatively, legacy content of a TrueHD bitstream may be adaptive audio content characterized by a sequence of different downmix matrices (or a continuously varying downmix matrix) that may also be quite arbitrary, and the full set of N channels (e.g., N object channels) indicated by the bitstream may be large (e.g., N may be as large as 16 in the Atmos version of Dolby TrueHD). Thus a static downmix matrix (i.e., a static version of rendering matrix, A, of equation (1) may not suffice to enable a legacy decoder to render a downmix presentation indicated by a TrueHD program, and instead a sequence of downmix matrices (or a continuously varying downmix matrix) may be required.

In accordance with the TrueHD format, each rendering matrix A(t) applied to audio content of a TrueHD bitstream is decomposed into a cascade of matrices, some of which are typically applied at the encoder and others of which are typically applied at the decoder/renderer:

$$A(t)=QQ_{s-1}(t)\ldots Q_0(t)I\,P_{r-1}(t)\ldots P_0(t)P,$$

where r and s are numbers, each of the r matrices $P_{r-1}(t), \ldots, P_0(t)$ is a primitive matrix of size N×N (these r matrices are referred to herein as input primitive matrices), each of the s matrices $Q_{s-1}(t), \ldots, Q_0(t)$ is a primitive matrix of size M×M (these s matrices are referred to herein as output primitive matrices), matrices P and Q determine input and output channel assignments, respectively. We will use the notation A(t) in a generic sense to refer to a true downmix (M<N), an upmix (M>N), or an N-to-N transformation (M=N). In the above equation I is the M×N row selector matrix whose first M columns are the same as the M×M identity matrix and the last N−M columns are zeros if M<N. On the other hand if M>N, I is a "tall" matrix whose first N rows are the N×N identity matrix and the last M−N rows are zeros. Specifically, when M≤N, the effect of the I matrix is to select the first M rows of the product $P_{r-1}(t)\ldots P_0(t)P$, and hence we refer to the matrix as a "row selector" matrix. Henceforth in this description we will simply refer to the notation I as a row selector matrix irrespective of the relation between M and N, with it being assumed that it has the appropriate structure based on the relation between M and N. The product (cascade) of matrices applied at the decoder/renderer is sometimes referred to as $U=QQ_{s-1}(t)\ldots Q_0(t)$, and the product (cascade) of matrices applied at the encoder is denoted by $V=P_{r-1}(t)\ldots P_0(t)P$. The purpose of the row selector matrix I indicated above in this paragraph is to specify the specific internal channels of the encoded program to which the decoder must apply U. In cases in which an N-to-N transformation is to be implemented, the decoder will need to apply U to all N internal channels of the encoded program and the row selector matrix will be an identity matrix.

Some embodiments of the present invention include, in an encoded audio program, metadata indicative of a cascade of primitive matrices (e.g., a cascade U as required by the TrueHD format) which may be used by a decoder (e.g., a legacy decoder) to render a downmix presentation indicated by the program.

An audio program rendering system (e.g., a decoder implementing such a system) may receive metadata (of an encoded audio program) which determine (e.g., with a time-varying cascade of matrices applied by an encoder) a time-varying rendering matrix A(t) only intermittently, and not at every instant "t" during the program. For example, this could be due to any of a variety of reasons, e.g., low time resolution of the system that actually outputs the metadata or the need to limit the bit rate of transmission of the program. It may be desirable for a rendering system to interpolate between rendering matrices A(t1) and A(t2), at time instants "t1" and "t2" during a program, respectively, to obtain a rendering matrix A(t3) for an intermediate time instant "t3." Interpolation ensures that the perceived position of objects in the rendered speaker feeds varies smoothly over time, and may eliminate undesirable artifacts such as zipper noise that stem from discontinuous (piece-wise constant) matrix updates. The interpolation may be linear (or nonlinear), and typically should ensure a continuous path in time from A(t1) to A(t2).

FIG. 1 is a schematic diagram of elements of a conventional TrueHD system, in which the encoder (30) and decoder (32) are configured to implement matrixing operations on audio samples. In the FIG. 1 system, encoder 30 is configured to encode 8 audio input channels as an encoded bitstream indicative of an 8-channel audio program (e.g., a traditional set of 7.1 speaker feeds), said encoded bitstream including two substreams, and decoder 32 is configured to decode the encoded bitstream to render either the 8-channel program (losslessly) or a 2-channel downmix of the original 8-channel program. Encoder 30 is coupled and configured to generate the encoded bitstream and to assert the encoded bitstream to delivery system 31.

In variations on the FIG. 1 system, N audio input signals are asserted to the encoder (where N is not equal to 8), the encoded bitstream output from the encoder has N channels (internal channels), and the decoder is configured to render at least one mix (e.g., a downmix comprising 2 channels) of content of the N input signals. The structure and operation of such variations will be apparent from the description herein of the FIG. 1 system (e.g., by generalizing the description herein by replacing the specific value "eight" with the general value "N").

Delivery system 31 is coupled and configured to deliver (e.g., by storing and/or transmitting) the encoded bitstream to decoder 32. In some embodiments, system 31 implements delivery of (e.g., transmits) an encoded multichannel audio program over a broadcast system or a network (e.g., the internet) to decoder 32. In some embodiments, system 31 stores an encoded multichannel audio program in a storage medium (e.g., a disk or set of disks), and decoder 32 is configured to read the program from the storage medium.

The block labeled "InvChAssign1" in encoder 30 is configured to perform channel permutation (equivalent to multiplication by a permutation matrix) on the input channels. The permutated channels then undergo encoding in stage 33, which outputs eight encoded signal channels. The encoded signal channels may (but need not) correspond to playback speaker channels. The encoded signal channels are sometimes referred to as "internal" channels since a decoder (and/or rendering system) typically decodes and renders the content of the encoded signal channels to recover the input audio, so that the encoded signal channels are "internal" to the encoding/decoding system. The encoding performed in stage 33 is equivalent to multiplication of each set of samples of the permutated channels by an encoding matrix (implemented as a cascade of n+1=r matrix multiplications, identified in FIG. 1 as $P_n^{-1}, \ldots, P_1^{-1}, P_0^{-1}$, to be described below in greater detail). The matrices identified in FIG. 1 as $P_n^{-1}, \ldots, P_1^{-1}, P_0^{-1}$, are primitive matrices which correspond, respectively, to primitive matrices $P_{r-1}(t), \ldots, P_0(t)$ in the above-described cascade $V=P_{r-1}(t)\ldots P_0(t)P$, in which P corresponds to the permutation matrix applied by block "InvChAssign1" of encoder 30.

Matrix determination subsystem 34 is configured to generate data indicative of the coefficients of two sets of output matrices (each of these sets corresponding to a different one of two substreams of the encoded channels). One set of output matrices consists of two matrices, $P_0^2$, $P_1^2$, each of which is a primitive matrix (defined below) of dimension 2×2, and is for rendering a first substream (a downmix substream) comprising two of the encoded audio channels of the encoded bitstream (to render a two-channel downmix of an eight-channel audio program). The matrices identified in FIG. 1 as $P_1^2$, $P_0^2$, are primitive matrices which correspond, respectively, to primitive matrices $Q_1(t)$, and $Q_0(t)$ in the above-described cascade $U=QQ_{s-1}(t) \ldots Q_0(t)$, with index s=2, and Q corresponding to a permutation matrix to be applied by the block "Ch Assign 0" of decoder 32. The other set of output matrices determined by subsystem 34 consists of rendering matrices, $P_0, P_1, \ldots, P_n$, each of which is a primitive matrix, and is for rendering a top substream comprising all eight of the encoded audio channels of the encoded bitstream (for recovery of the eight-channel audio program). The matrices identified in FIG. 1 as $P_n, \ldots, P_1$, $P_0$, correspond, respectively, to primitive matrices $Q_{s-1}(t), \ldots,$ and $Q_0(t)$ in the above-described cascade $U=QQ_{s-1}(t) \ldots Q_0(t)$, with index s=n+1, and Q corresponding to a permutation matrix to be applied by the block "Ch Assign 1" of decoder 32.

A cascade of the matrices $P_0^{-1}, P_1^{-1}, \ldots, P_n^{-1}$ of FIG. 1, applied to the audio (with the necessary permutation matrix P) at the encoder, together with a cascade of the matrices, $P_0^2$, $P_1^2$, applied to the audio at the decoder (with the necessary permutation matrix Q), is equal to the downmix matrix specification that transforms the 8 audio channels indicated by the encoded bitstream to the 2-channel downmix. A cascade of the matrices $P_0^{-1}, P_1^{-1}, \ldots, P_n^{-1}$ of FIG. 1, applied to the audio (with the necessary permutation matrix P) at the encoder, together with a cascade of the matrices $P_0, P_1, \ldots, P_n$ of FIG. 1, applied to the audio at the decoder (with the necessary permutation matrix Q), renders the full set of 8 encoded channels of the encoded bitstream.

The coefficients (of each of matrix) that are output from subsystem 34 of encoder 30 to packing subsystem 35 are metadata indicating relative or absolute gain of each channel to be included in a corresponding mix of channels of the program. The coefficients of each rendering matrix (for an instant of time during the program) represent how much each of the channels of a mix should contribute to the mix of audio content (at the corresponding instant of the rendered mix) indicated by the speaker feed for a particular playback system speaker.

The eight encoded audio channels (output from encoding stage 33), the output matrix coefficients (generated by subsystem 34), and typically also additional data are asserted to packing subsystem 35, which assembles them into the encoded bitstream which is then asserted to delivery system 31. Encoder 30 may also include in the encoded bitstream (to be asserted to delivery system 31) values indicative of the permutation matrix Q to be applied by block "Ch Assign 0" of decoder 32.

The encoded bitstream includes data indicative of the eight encoded audio channels, the two sets of output matrices, and typically also additional data (e.g., metadata regarding the audio content).

Parsing subsystem 36 of decoder 32 is configured to accept (read or receive) the encoded bitstream from delivery system 31 and to parse the encoded bitstream. Subsystem 36 is operable to assert the substreams of the encoded bitstream, including a "first" substream comprising only two of the encoded channels of the encoded bitstream, and output matrices ($P_0^2$, $P_1^2$) corresponding to the first substream, to matrix multiplication stage 38 (for processing which results in a 2-channel downmix presentation of content of the full 8-channel program). Subsystem 36 is also operable to assert all the substreams (i.e., a top substream) of the encoded bitstream (comprising all eight encoded channels of the encoded bitstream) and corresponding output matrices ($P_0$, $P_1, \ldots, P_n$) to matrix multiplication stage 37 for processing which results in recovery and rendering of the full 8-channel program.

More specifically, stage 38 multiplies two audio samples of the two channels of the first substream by a cascade of the matrices $P_0^2$, $P_1^2$ , and each resulting set of two linearly transformed samples undergoes channel permutation (equivalent to multiplication by a permutation matrix) represented by the block titled "ChAssign0" to yield each pair of samples of the required 2 channel downmix of the 8 original audio channels. The cascade of matrixing operations performed in encoder 30 and decoder 32 is equivalent to application of a downmix matrix specification that transforms the 8 input audio channels to the 2-channel downmix.

Stage 37 multiplies each vector of eight audio samples (one from each of the full set of eight channels of the encoded bitstream) by a cascade of the matrices $P_0$, $P_1, \ldots, P_n$, and each resulting set of eight linearly transformed samples undergoes channel permutation (equivalent to multiplication by a permutation matrix) represented by the block titled "ChAssign1" to yield each set of eight samples of the recovered 8-channel program. In order that the output 8 channel audio is exactly the same as the 8-channel audio originally input to encoder 30 (to achieve the "lossless" characteristic of the system), the matrixing operations performed in encoder 30 should be exactly (including quantization effects) the inverse of the matrixing operations performed in decoder 32 on all substreams of the encoded bitstream (i.e., multiplication by the cascade of matrices $P_0, P_1, \ldots, P_n$). Thus, in FIG. 1, the matrixing operations in stage 33 of encoder 30 are identified as a cascade of the inverse matrices of the matrices $P_0$, $P_1, \ldots, P_n$, in the opposite sequence applied in stage 37 of decoder 32, namely: $P_n^{-1}, \ldots, P_1^{-1}, P_0^{-1}$.

When reconstructing the original N input signals losslessly, decoder 32 applies the inverse of the channel permutation applied by encoder 30 (i.e., the permutation matrix represented by element "ChAssign1" of decoder 32 is the inverse of that represented by element "InvChAssign1" of encoder 30).

Given a downmix matrix specification (e.g., specification of a static matrix A that is 2×8 in dimension), an objective of a conventional TrueHD encoder implementation of encoder 30 is to design output matrices (e.g., $P_0, P_1, \ldots, P_n$ and $P_0^2$, $P_1^2$ of FIG. 1), and input matrices ($P_n^{-1}, \ldots, P_1^{-1}$, $P_0^{-1}$) and output (and input) channel assignments so that:

1. the encoded bitstream is hierarchical (i.e., in the example, the first two encoded channels are sufficient to derive the 2 channel downmix presentation, and the full set of eight encoded channels is sufficient to recover the original 8 input signals); and
2. the matrices for the topmost stream ($P_0, P_1, \ldots, P_n$ in the example) are exactly invertible so that the input audio is exactly retrievable by the decoder.

Typical computing systems work with finite precision and inverting an arbitrary invertible matrix exactly could require very large precision. TrueHD solves this problem by constraining the output matrices and input matrices (i.e., $P_0$, $P_1, \ldots, P_n$ and $P_n^{-1}, \ldots, P_1^{-1}, P_0^{-1}$) to be square matrices of the type known as "primitive matrices".

A primitive matrix P of dimension N×N is of the form:

$$P = \begin{bmatrix} 1 & 0 & \ddots & \ddots & 0 \\ 0 & 1 & 0 & \ddots & \ddots \\ \alpha_0 & \alpha_1 & \alpha_2 & \ddots & \alpha_{N-1} \\ \vdots & \ddots & \ddots & \ddots & \ddots \\ 0 & 0 & 0 & 0 & 1 \end{bmatrix}.$$

A primitive matrix is always a square matrix. A primitive matrix of dimension N×N is identical to the identity matrix of dimension N×N except for one (non-trivial) row (i.e., the row comprising elements $\alpha_0, \alpha_1, \alpha_2, \ldots \alpha_{N-1}$ in the example). In all other rows, the off-diagonal elements are zeros and the element shared with the diagonal has an absolute value of 1 (i.e., either +1 or −1). To simplify language in this disclosure, the drawings and descriptions will always assume that a primitive matrix has diagonal elements that are equal to +1 with the possible exception of the diagonal element in the non-trivial row. However, we note that this is without loss of generality, and ideas presented in this disclosure pertain to the general class of primitive matrices where diagonal elements may be +1 or −1.

When a primitive matrix, P, operates on (i.e., multiplies) a vector x(t), the result is the product Px(t), which is another N-dimensional vector that is exactly the same as x(t) in all elements except one. Thus each primitive matrix can be associated with a unique channel which it manipulates (or on which it operates).

We will use the term "unit primitive matrix" herein to denote a primitive matrix in which the element shared with the diagonal (by the non-trivial row of the primitive matrix) has an absolute value of 1 (i.e., either +1 or −1). Thus, the diagonal of a unit primitive matrix consists of all positive ones, +1, or all negative ones, −1, or some positive ones and some negative ones. A primitive matrix only alters one channel of a set (vector) of samples of audio program channels, and a unit primitive matrix is also losslessly invertible due to the unit values on the diagonal. Again, to simplify the discussion herein, we will use the term unit primitive matrix to refer to a primitive matrix whose non-trivial row has a diagonal element of +1. However, all references to unit primitive matrices herein, including in the claims, are intended to cover the more generic case where a unit primitive matrix can have a non-trivial row whose shared element with the diagonal is +1 or −1.

If $\alpha_2=1$ (resulting in a unit primitive matrix having a diagonal consisting of positive ones) in the above example of primitive matrix, P, it is seen that the inverse of P is exactly:

$$P^{-1} = \begin{bmatrix} 1 & 0 & \ddots & \ddots & 0 \\ 0 & 1 & 0 & \ddots & \ddots \\ -\alpha_0 & -\alpha_1 & 1 & \ddots & -\alpha_{N-1} \\ \vdots & \ddots & \ddots & \ddots & \ddots \\ 0 & 0 & 0 & 0 & 1 \end{bmatrix}.$$

It is true in general that the inverse of a unit primitive matrix is simply determined by inverting (multiplying by −1) each of its non-trivial a coefficients which does not lie along the diagonal.

If the matrices $P_0, P_1, \ldots, P_n$ employed in decoder 32 of FIG. 1 are unit primitive matrices (having unit diagonals), the sequence of matrixing operations $P_n^{-1}, \ldots, P_1^{-1}, P_0^{-1}$ in encoder 30 and $P_0, P_1. \ldots, P_n$ in decoder 32 can be implemented by finite precision circuits. Details of typical implementations of such finite precision circuits are described in above-cited U.S. Pat. No. 6,611,212, issued Aug. 26, 2003.

Application of a sequence of cascades (i.e., two or more cascades, each corresponding to a different time, or just one cascade) of primitive matrices (e.g., a sequence of cascades of primitive N×N matrices $P_0^{-1}, P_1^{-1}, \ldots, P_n^{-1}$ of FIG. 1, each cascade $P_0^{-1}, P_1^{-1}, \ldots, P_n^{-1}$ in the sequence corresponding to a specific time) and a permutation matrix P (together corresponding to application of above-mentioned matrix cascade $V=P_{r-1}(t) \ldots P_0(t)P$) by an encoder (e.g., encoder 30 of FIG. 1), with application of a row selector matrix (corresponding to above-mentioned matrix I, where the row selector matrix is the N×N identity matrix for an N-to-N transformation), and application by a decoder (e.g., decoder 32 of FIG. 1) of a sequence of cascades of primitive matrices (e.g., a sequence of primitive matrix cascades $P_0$, $P_1, \ldots, P_n$ of FIG. 1) and another permutation matrix Q (together corresponding to application of above-mentioned matrix cascade $U=QQ_{s-1}(t) \ldots Q_0(t)$), to a vector of N audio input samples (each of which is a sample of a different channel of a first set of N channels) can implement any linear transformation of the samples into a new set of N samples. Such an operation on the input samples can implement the linear transformation performed at a time t by multiplying samples of N channels of an audio program (e.g., an object-based audio program) by an implementation of matrix A(t) of equation (1) having the above-described form, $A(t)=QQ_{s-1}(t) \ldots Q_0(t)\ I\ P_{r-1}(t) \ldots P_0(t)P$, during rendering of the channels into N speaker feeds, where the transformation is achieved by manipulating one channel at a time. Multiplication of a set of N audio samples by the sequence of matrices in this implementation of A(t) represents a generic set of scenarios in which the set of N input samples is converted to another set of N samples by linear operations.

With reference again to a TrueHD implementation of decoder 32 of FIG. 1, in order to maintain uniformity of TrueHD decoder architecture, the output matrices of the downmix substream ($P_0^2$, $P_1^2$ in FIG. 1) are also implemented as primitive matrices although they need not be invertible (or have a unit diagonal) since they are not associated with achieving losslessness.

The input and output primitive matrices employed in a TrueHD encoder and decoder to render a downmix depend on each particular downmix specification to be implemented. The function of a TrueHD decoder is to apply the appropriate cascade of primitive matrices to the received encoded audio bitstream. Thus, the TrueHD decoder of FIG. 1 decodes a subset of the 8 channels of the encoded bitstream (delivered by system 31), and generates a 2-channel downmix by applying a cascade of two output primitive matrices $P_0^2$, $P_1^2$ to a subset of the channels of the decoded bitstream. A TrueHD implementation of decoder 32 of FIG. 1 is also operable to decode the 8 channels of the encoded bitstream (delivered by system 31) to recover the full 8-channel program by applying a cascade of eight output primitive matrices $P_0, P_1, \ldots, P_n$ to the channels of the encoded bitstream.

If an object-based audio program (e.g., comprising more than eight channels) were encoded by a conventional TrueHD encoder, the encoder might generate one or more downmix substreams which carry presentations compatible with legacy playback devices (e.g., presentations which could be decoded to downmixed speaker feeds for playback on a traditional 7.1 channel or 5.1 channel or other traditional speaker array) and a top substream (indicative of all channels of the input program). A TrueHD decoder might recover the full object-based audio program losslessly for rendering by a playback system. Application of each input matrix sequence by the encoder in this case to generate a substream (e.g., a downmix substream), with application by a decoder/renderer of a corresponding output matrix sequence (determined by the encoder for application by the decoder/renderer), typically corresponds to application of a time-varying rendering matrix, A(t), which linearly transforms samples of input channels to generate a mix (e.g., a 7.1 channel or 5.1 channel downmix, or another downmix) of content of the original input channels. However, such a matrix A(t) would typically vary rapidly in time (e.g., as audio objects move around in the spatial scene), and bit-rate and processing limitations of a conventional TrueHD system (or other conventional encoding and decoding system) would typically constrain the system to be able at most to accommodate a piece-wise constant approximation to such a continuously (and typically rapidly) varying matrix specification (with a higher matrix update rate achieved at the cost of increased bit-rate for transmission of the encoded program). In order to support rendering of content of object-based multichannel audio programs (and other multichannel audio programs) into speaker feeds indicative of a rapidly varying mix of audio content of the programs, the inventors have recognized that it is desirable to apply a sequence of rendering matrices to input audio data (i.e., to apply an initial rendering matrix, and then a sequence of updated rendering matrices), with discontinuity compensation corresponding to at least one rendering matrix update (e.g., each rendering matrix update). The discontinuity compensation for each relevant update should compensate for a discontinuity in the rendered audio that would otherwise result (i.e., if the compensation were not performed) from the matrix update. It is contemplated that the rendering matrix updates are typically infrequent and that a desired trajectory (i.e., a desired sequence of mixes of content of input channels) between updates is specified parametrically. In some embodiments, in response to an update of a rendering matrix (e.g., in response to each transition between consecutive rendering matrices of a sequence of rendering matrices), a set of correction values is determined for application to audio data during encoding and/or rendering.

BRIEF DESCRIPTION OF THE INVENTION

Some embodiments of the present invention apply discontinuity correction values to audio samples (e.g., by implanting matrix multiplication on data indicative of the values and the samples) to generate an encoded audio program having N channels of audio content, and optionally also include data indicative of at least some of the discontinuity correction values in the program for application by a decoder/renderer.

In a first class of embodiments, the invention is a method for generating an encoded audio program, including steps of:

(a) encoding N audio input signals (e.g., N signals indicative of N channels of an object-based audio program or another audio program) as N channels of encoded audio content, in accordance with a sequence of rendering matrices (e.g., a sequence of rendering matrices A, specified over a time interval which is a sequence of subintervals, each of the subintervals is identified by a different value of an index, i) specified for rendering audio content of at least some of the N audio input signals, where transitions between matrices of the sequence of rendering matrices occur at update times;

(b) determining discontinuity correction values, for application to encoded audio content of at least some of the N channels at (e.g., for an interval of short duration commencing at) at least one of the update times, to implement discontinuity correction at said at least one of the update times; and (c) generating the encoded audio program to include N channels of discontinuity-corrected, encoded audio content, including by applying at least some of the discontinuity correction values to the encoded audio content of at least some of the N channels.

In some embodiments in the first class, step (c) includes a step of generating the encoded audio program to be indicative of at least some of the discontinuity correction values (e.g., the discontinuity correction values include a prototype signal set of order n, where n is an integer indicative of an order of discontinuity correction, and the encoded audio program is generated to be indicative of the prototype signal set).

In some embodiments in the first class, the discontinuity correction values include values which determine a prototype signal set of order n, where n is an integer indicative of an order of discontinuity correction, and both the encoding of the N audio input signals as N channels of encoded audio content, and the application of said at least some of the discontinuity correction values to the encoded audio content of at least some of the N channels, are implemented by performance of a matrix multiplication (e.g., multiplication by a cascade of matrices) on data indicative of a vector whose elements are a sequence of the N audio input signals and the prototype signal set.

In some embodiments in the first class, step (b) includes steps of:

determining a prototype signal set of order n, where n is an integer indicative of an order of discontinuity correction (e.g., when, n=0, the prototype signal set consists of a single prototype signal, $p_0(t)$, of a type described herein. For another example, when n=1, the prototype signal set may consist of a zeroth order discontinuity correction prototype signal, $p_0(t)$, and a first order discontinuity correction prototype signal, $p_1(t)$. Alternatively, if n is greater than or equal to 1, the prototype signal set could consist of just one prototype signal, e.g., $p_1(t)$ (e.g., if there is no zeroth order discontinuity at the relevant update time) or $p_2(t)$ (e.g., if there is no zeroth order or first order discontinuity at the relevant update time)); and determining correction scaling coefficients (e.g., coefficients $b_{i,j}(t)$, of a type described herein) such that application of the prototype signal set, scaled by the correction scaling coefficients, to the encoded audio content of the at least some of the N channels at said at least one of the update times, implements at least partially the discontinuity correction at said at least one of the update times. Optionally, step (c) also includes a step of including the prototype signal set in the encoded audio program (e.g., in segments ("slots") which could otherwise include additional channels of encoded audio content).

In some embodiments, the sequence of rendering matrices has been specified for rendering at least one mix of audio content of at least some of the N audio input signals (e.g., at least one M-channel mix, where M is an integer, and M is less than, or equal to, or greater than N), the sequence of rendering matrices determines a sequence of input rendering matrices (e.g., a sequence of N×N input matrices V of a type described below) to be applied by an encoder, and at least one sequence of output rendering matrices (e.g., a sequence of M×M output matrices U of a type described below) to be applied by a decoder. In some such embodiments, the correction scaling coefficients with the sequence of input rendering matrices determine a sequence of augmented input rendering matrices, and step (c) includes a step of applying the augmented input rendering matrices to the N input signals and the prototype signal set.

In a second class of embodiments, the invention is a decoder, including:

a memory which stores, in non-transient manner, at least one segment of an encoded audio program which includes N channels of discontinuity-corrected, encoded audio content, and data indicative of an output rendering matrix (e.g., an M×M matrix, or a cascade of M×M primitive matrices, where N and M are integers (e.g., N≥M)), and optionally also data indicative of discontinuity correction values; and a mix generation subsystem coupled and configured to mix samples of the discontinuity-corrected, encoded audio content, including by applying to the samples said data indicative of the output rendering matrix, to generate an M-channel mix of at least some of the discontinuity-corrected, encoded audio content, where a sequence of rendering matrices (e.g., augmented rendering matrices $A_i''(t)$ specified over a time interval which is a sequence of subintervals, each of the subintervals identified by a different value of an index, i) has been specified for rendering the M-channel mix, where transitions between matrices of the sequence of rendering matrices occur at update times, and wherein the N channels of discontinuity-corrected, encoded audio content have been generated by applying discontinuity correction values to N channels of audio content to implement discontinuity correction at at least one of the update times.

In some embodiments in the second class, the encoded audio program (e.g., the segment of the program stored in the memory) includes data indicative of at least some of the discontinuity correction values, the output rendering matrix is an augmented version of an M×M matrix, and the mix generation subsystem is configured to mix the samples including by applying to said samples, and to at least some of the discontinuity correction values (e.g., a prototype signal set), said data indicative of the output rendering matrix.

In a third class of embodiments, the invention is a method for generating an encoded audio program, including steps of:

(a) encoding N audio input signals (e.g., N signals indicative of N channels of an object-based audio program or another audio program) as N channels of discontinuity-corrected, encoded audio content, including by performing a sequence of linear transformations on audio content of the audio input signals such that performance of the linear transformations at update times (e.g., for an interval of short duration commencing at each of the update times) includes application of discontinuity correction values to audio content of the audio input signals to implement discontinuity correction at the update times; and (b) generating the encoded audio program to include the N channels of discontinuity-corrected, encoded audio content, wherein the encoding is performed in accordance with a discontinuity-corrected M-channel mix of content of at least some of the audio input signals, such that rendering of the encoded audio program determines the discontinuity-corrected M-channel mix of content, where M is less than or greater than or equal to N (in typical embodiments, M is less than N), and wherein the discontinuity correction values include correction scaling coefficients and a prototype signal set of order n, where n is an integer indicative of an order of discontinuity correction (e.g., n=0), and the prototype signal set consists of n+1 unscaled correction signals.

In some embodiments in the third class, the discontinuity-corrected M-channel mix is specified over a time interval which is a sequence of subintervals, each of the subintervals is identified by a different value of an index, i, the update times are transitions between consecutive ones of the subintervals, and the discontinuity-corrected M-channel mix determines the correction scaling coefficients and the prototype signal set. In some such embodiments, the discontinuity-corrected M-channel mix determines the correction scaling coefficients, the prototype signal set, and output discontinuity correction values to be applied during rendering of the encoded audio program, and step (b) includes a step of including at least some of the output discontinuity correction values in the encoded audio program.

In some embodiments, in the third class, the discontinuity-corrected M-channel mix has been determined by:

determining a sequence of mixes of the N input signals to M output channels over the time interval, where x(t) is an N×1 matrix whose elements are the N audio input signals, and where for each value of the index i, $A_i$ is an M×N rendering matrix such that $A_i x(t)$ (i.e., the result of matrix multiplication of x(t) by $A_i$) is a mix in said sequence of mixes specified for the corresponding one of the subintervals; and for each value of the index i, determining an augmented rendering matrix $A_i''$ which is an M×(N+n+1) rendering matrix whose elements are identical to the elements of rendering matrix $A_i$ augmented by n+1 columns of scaling coefficients, and a sequence of augmented matrices $x_i''(t)$, where each said augmented matrix $x_i''(t)$ is an (N+n+1)×1 matrix including N elements which are the N audio input signals, and n+1 additional elements which are an unscaled correction signal set of order n (i.e., the unscaled correction signal set consists of unscaled correction signals $p_0(t), \ldots, p_n(t)$), such that $A_i''x_i''(t)$ (i.e., the result of matrix multiplication of $x_i''(t)$ by $A_i''$) is a corrected mix for the corresponding one of the subintervals, where the corrected mix determines a sequence of discontinuity-corrected mixes over the time interval which is the discontinuity-corrected M-channel mix, and where the unscaled correction signal set and the scaling coefficients determine, respectively, the prototype signal set and the correction scaling coefficients applied during step (a). Typically, the sequence of mixes is indicative of at least one uncorrected discontinuity, of order n, at a transition between two consecutive ones of the subintervals, and the sequence of discontinuity-corrected mixes is indicative of at least one reduced discontinuity, of the order n, at the transition between the two consecutive ones of the subintervals. Desirably, the reduced discontinuity is less perceptible (when the sequence of discontinuity corrected mixes is rendered) than is the uncorrected discontinuity when the sequence of mixes is rendered).

In another class of embodiments, the invention is a method for encoding N audio input signals (e.g., N signals indicative of N channels of an object-based audio program or another audio program) specified over a time interval which is a sequence of subintervals, each of the subintervals is identified by a different value of an index, i, and a sequence of mixes of N input signal channels to M output channels has been specified over the time interval (e.g., the output channels correspond to playback speaker channels), where M is less than or equal to N, and where for each value of the index i, $A_i$ is a mix in said sequence of mixes which has been specified for the corresponding one of the subintervals, said method including steps of:

for each value of the index i, determining a first matrix cascade $V_i$ (including a cascade of N×N input primitive matrices) for application to samples of the N input signal channels to generate N encoded signal channels, and a second matrix cascade $U_i$ (including a cascade of M×M output primitive matrices) such that application of the second matrix cascade $U_i$ to samples of M of the N encoded signal channels, implements the mix $A_i$ of audio content of the N input signal channels to the M output channels;

for at least one value of the index i, determining a sequence of modified first cascades V', (including a cascade of modified input primitive matrices), a prototype signal set, and a sequence of modified second cascades $U'_i$ (where, for each time in the subinterval identified by index i, $U'_i$ may be identical to or different than $U_i$ but $V'_i$ is not identical to $V_i$) such that application of the sequence of modified first cascades $V'_i$, to samples of the N input signal channels and the prototype signal set, generates discontinuity-corrected encoded signal channels, and application of the sequence of modified second cascades $U'_i$ to samples of at least some of the discontinuity-corrected encoded signal channels implements a discontinuity-corrected mix of audio content of the N input signal channels to the M output channels (herein, a "sequence" of cascades denotes two or more cascades, each corresponding to a different time, or just one cascade); and generating an encoded bitstream, including by applying the sequence of modified first cascades $V'_i$ for said at least one value of the index i, to samples of the N input signal channels, and including in the encoded bitstream data indicative of the sequence of modified second cascades $U'_i$ for said at least one value of the index i.

Aspects of the invention include a system or device (e.g., an encoder or decoder, or a rendering system) configured (e.g., programmed) to implement any embodiment of the inventive method, a system or device including a memory (e.g., a buffer memory) which stores (e.g., in a non-transitory manner) at least one frame or other segment of an encoded audio program generated by any embodiment of the inventive method or steps thereof, and a computer readable medium (e.g., a disc) which stores code (e.g., in a non-transitory manner) for implementing any embodiment of the inventive method or steps thereof. For example, the inventive system can be or include a programmable general purpose processor, digital signal processor, or microprocessor, programmed with software or firmware and/or otherwise configured to perform any of a variety of operations on data, including an embodiment of the inventive method or steps thereof. Such a general purpose processor may be or include a computer system including an input device, a memory, and processing circuitry programmed (and/or otherwise configured) to perform an embodiment of the inventive method (or steps thereof) in response to data asserted thereto.

Other aspects of the invention are methods performed by any embodiment of the inventive system or device (or steps of such methods).

BRIEF DESCRIPTION OF THE DRAWINGS

FIG. 2 is a graph of a sequence of rendered audio samples of an audio channel, which determine a rendered waveform. The rendered samples are generated by applying a time-invariant rendering matrix to input samples.

FIG. 3 is a graph of a sequence of rendered audio samples of an audio channel, which determine a rendered waveform. The rendered samples are generated by applying a first rendering matrix to input samples prior to time k, and then applying a different (updated) rendering matrix to input samples starting at the time k.

FIG. 4 is a graph of the difference between the FIG. 2 signal and the FIG. 3 signal.

FIG. 5 is a graph of an unscaled correction signal (a "prototype" signal) for correcting the zeroth order discontinuity in the FIG. 3 signal (i.e., the zeroth order discontinuity at time k).

FIG. 6 is a graph of a corrected version of the FIG. 3 signal, which is generated by adding a scaled version of the FIG. 5 signal (the FIG. 5 signal, scaled by the factor "b" indicated in FIG. 4) to the FIG. 3 signal.

NOTATION AND NOMENCLATURE

Figure 1:
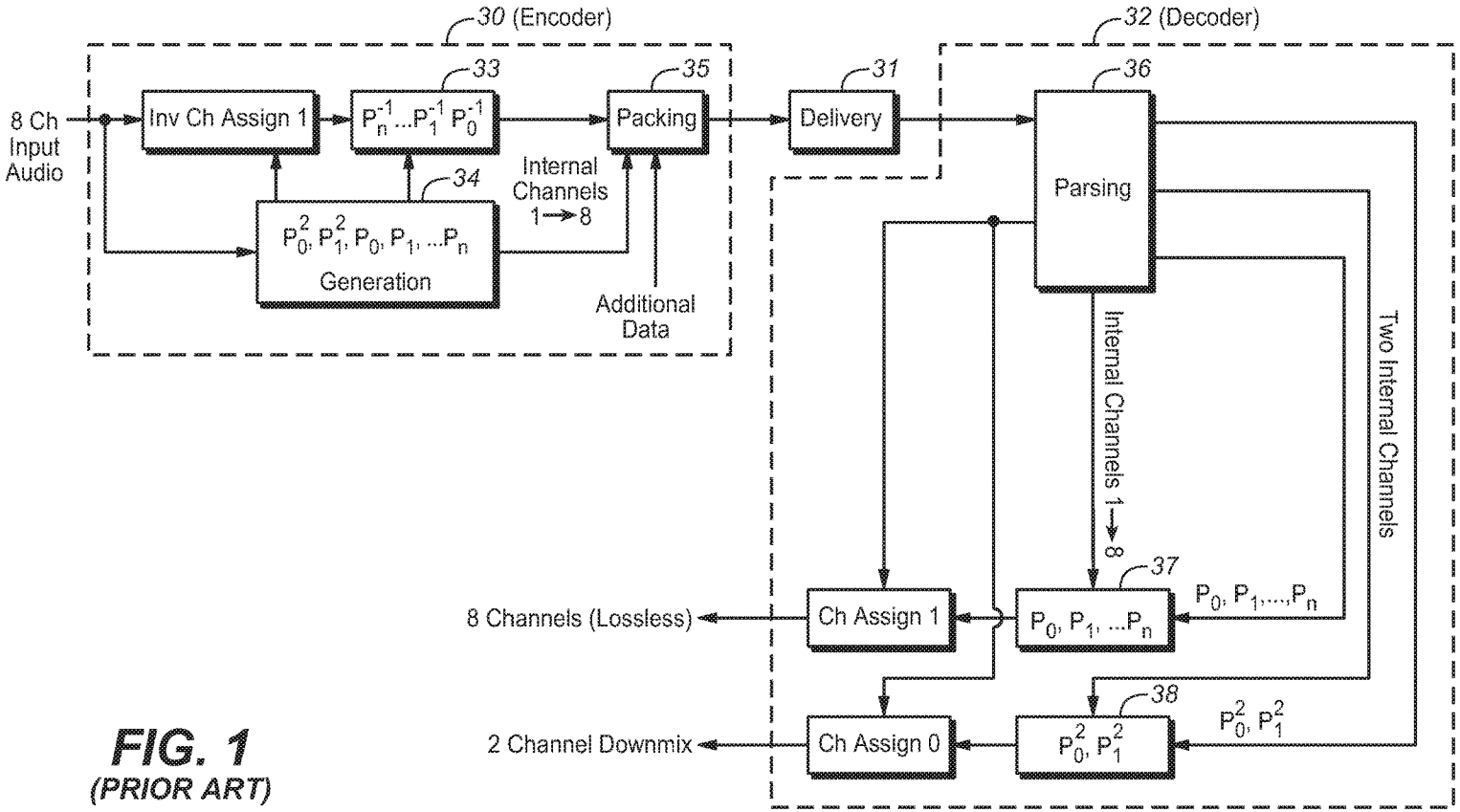
FIG. 1 (PRIOR ART)
FIG. 1 is a block diagram of elements of a conventional system including an encoder, a delivery subsystem, and a decoder.

Throughout this disclosure, including in the claims, the expression performing an operation "on" a signal or data (e.g., filtering, scaling, transforming, or applying gain to, the signal or data) is used in a broad sense to denote performing the operation directly on the signal or data, or on a processed version of the signal or data (e.g., on a version of the signal that has undergone preliminary filtering or pre-processing prior to performance of the operation thereon).

Throughout this disclosure including in the claims, the expression "system" is used in a broad sense to denote a device, system, or subsystem. For example, a subsystem that implements a decoder may be referred to as a decoder system, and a system including such a subsystem (e.g., a system that generates Y output signals in response to multiple inputs, in which the subsystem generates M of the inputs and the other Y−M inputs are received from an external source) may also be referred to as a decoder system.

Throughout this disclosure including in the claims, the term "processor" is used in a broad sense to denote a system or device programmable or otherwise configurable (e.g., with software or firmware) to perform operations on data (e.g., audio, or video or other image data). Examples of processors include a field-programmable gate array (or other configurable integrated circuit or chip set), a digital signal processor programmed and/or otherwise configured to perform pipelined processing on audio or other sound data, a programmable general purpose processor or computer, and a programmable microprocessor chip or chip set.

Throughout this disclosure including in the claims, the expression "metadata" refers to separate and different data from corresponding audio data (audio content of a bitstream which also includes metadata). Metadata is associated with audio data, and indicates at least one feature or characteristic of the audio data (e.g., what type(s) of processing have already been performed, or should be performed, on the audio data, or the trajectory of an object indicated by the audio data). The association of the metadata with the audio data is time-synchronous. Thus, present (most recently received or updated) metadata may indicate that the corresponding audio data contemporaneously has an indicated feature and/or comprises the results of an indicated type of audio data processing.

Throughout this disclosure including in the claims, the term "couples" or "coupled" is used to mean either a direct or indirect connection. Thus, if a first device couples to a second device, that connection may be through a direct connection, or through an indirect connection via other devices and connections.

Throughout this disclosure including in the claims, the following expressions have the following definitions:

speaker and loudspeaker are used synonymously to denote any sound-emitting transducer. This definition includes loudspeakers implemented as multiple transducers (e.g., woofer and tweeter);

speaker feed: an audio signal to be applied directly to a loudspeaker, or an audio signal that is to be applied to an amplifier and loudspeaker in series;

channel (or "audio channel"): a monophonic audio signal. Such a signal can typically be rendered in such a way as to be equivalent to application of the signal directly to a loudspeaker at a desired or nominal position. The desired position can be static, as is typically the case with physical loudspeakers, or dynamic;

audio program: a set of one or more audio channels (at least one speaker channel and/or at least one object channel) and optionally also associated metadata (e.g., metadata that describes a desired spatial audio presentation);

speaker channel (or "speaker-feed channel"): an audio channel that is associated with a named loudspeaker (at a desired or nominal position), or with a named speaker zone within a defined speaker configuration. A speaker channel is rendered in such a way as to be equivalent to application of the audio signal directly to the named loudspeaker (at the desired or nominal position) or to a speaker in the named speaker zone;

object channel: an audio channel indicative of sound emitted by an audio source (sometimes referred to as an audio "object"). Typically, an object channel determines a parametric audio source description (e.g., metadata indicative of the parametric audio source description is included in or provided with the object channel). The source description may determine sound emitted by the source (as a function of time), the apparent position (e.g., 3D spatial coordinates) of the source as a function of time, and optionally at least one additional parameter (e.g., apparent source size or width) characterizing the source; and object based audio program: an audio program comprising a set of one or more object channels (and optionally also comprising at least one speaker channel) and optionally also associated metadata (e.g., metadata indicative of a trajectory of an audio object which emits sound indicated by an object channel, or metadata otherwise indicative of a desired spatial audio presentation of sound indicated by an object channel, or metadata indicative of an identification of at least one audio object which is a source of sound indicated by an object channel).

DETAILED DESCRIPTION OF EMBODIMENTS OF THE INVENTION

Examples of embodiments of the invention will be described with reference to FIGS. 2-9.

Hybrid audio content including both bed channels and object channels that are not bed channels (e.g., Atmos content) is typically transmitted as a combination of coded waveforms and metadata specified at regular intervals of time. Thus, the rendering matrix A(t) is specified only at certain instants of time and the rendering matrix at intermediate time instants may be obtained by interpolation between the specified samples of the rendering matrix trajectory.

Different interpolation strategies can be employed based on complexity or other system constraints. The smoothness of the achieved matrix trajectory depends on the interpolation strategy. Suppose that the matrix trajectory determined by A(t) has been specified in terms of three samples A(t1), A(t2), and A(t3) at three time instants $t1<t2<t3$. One strategy could be simply to hold the matrix at A(t1) for all times t which satisfy $t1 \leq t<t2$. Clearly this results in a "zeroth order" discontinuity in the rendering matrix trajectory at time t2 (assuming A(t1) and A(t2) are not equal). This in turn may lead to a visible discontinuity in the rendered waveform.

Another strategy may be to derive the rendering matrix A(t) at times t between t1 and t2 via appropriate linear interpolation between A(t1) and A(t2), and at times t between t2 and t3 via similar interpolation between A(t2) and A(t3). This ensures that there is no discontinuity in the matrix trajectory at time t2. However, the trajectory is still only piecewise linear and there could be a discontinuity in the derivative of the trajectory, i.e., a "first order" discontinuity. While a first order discontinuity is not a visible discontinuity in the rendered waveform, the effect of a linear interpolation which is not smooth (i.e., which results in at least one first order discontinuity, and optionally also at least one second order (or other higher order) discontinuity) can be visible in the spectrogram of the rendered signal as spectral splatter (especially if the signals to be rendered are very smooth/sinusoidal in nature). This has the potential to result in audible artifacts akin to clicks/sparkles in the rendered signal. In order to ameliorate such artifacts, interpolation strategies that result in more smoothing (for instance, rendering in the Quadrature Mirror Filterbank (QMF) domain) are preferred. Note that the discontinuities happen at an "update point", i.e., a time where something about the matrix trajectory changes. In the case of a zeroth order discontinuity the matrix itself changes abruptly at the update point, while in the case of the first order discontinuity the interpolation slope changes.

Sometimes the smoothing strategy is dictated by system constraints. For example, consider transmission of Atmos content via Dolby TrueHD. Dolby TrueHD is an audio codec that supports lossless and scalable transmission of audio signals. The source audio (e.g., hybrid audio content including both bed channels and object channels that are not bed channels) is encoded into a hierarchy of substreams such that only a subset of the substreams need to be retrieved from the bitstream and decoded, in order to obtain a lower dimensional ("downmix") presentation of the spatial scene (e.g., a downmix presentation of hybrid audio content including both bed channels and object channels that are not bed channels). When all the substreams are decoded the resultant audio is identical to the source audio.

Recent extensions to Dolby TrueHD accommodate the transmission of hybrid audio content (indicative of audio objects and optionally also bed channels) losslessly such that backwards compatible renderings (downmixes) of the content to standard speaker layouts (e.g., stereo, 5.1, and 7.1) can be derived without recourse to decoding and rendering each object channel completely. This feature benefits legacy playback devices that cannot render the audio objects, but can playback the downmixes. The encoder receives samples (e.g., the matrices A(t1), A(t2), and A(t3) in the above example) of the desired rendering matrix trajectory and decomposes each such "specified" matrix (e.g., A(t1), A(t2), and A(t3)) into a product of input primitive matrices and output primitive matrices (described below with reference to equation (3)). At the encoder, the input primitive matrices are applied to the input audio signals (objects) to create an equal number of internal channels that are coded into the bitstream. At the TrueHD decoder a subset of the internal channels are retrieved and multiplied by output primitive matrices (sent in the bitstream) to create the required downmix. Backwards compatibility requirements dictate that the output primitive matrices have to be piecewise constant, while linear interpolation (in time) is allowed between input primitive matrices obtained by decomposition of consecutive samples of the matrix trajectory. Thus at the decoder a downmix corresponding to a continuously varying matrix trajectory can be obtained by the cascade of interpolated input primitive matrices and piecewise constant output primitive matrices. Note that this "achieved" matrix trajectory (obtained by interpolation between primitive matrices) is not necessarily the same as the matrix trajectory that would be obtained by linear interpolation between the specified matrices.

The TrueHD encoder and decoder therefore together form a rendering system for the objects, and enable object audio playback from legacy playback devices that cannot by themselves interpret the objects or associated metadata. Clearly, the smoothness of the achieved matrix trajectory is dependent on the change in interpolation slopes of the primitive matrices and their interaction when multiplied in cascade. Further, interpolation between input primitive matrices in the decompositions of two specified matrices, e.g., A(t1) and A(t2), is only possible when certain conditions on the parameters of the decomposition are satisfied. On rare occasion there may exist no decomposition of the specified matrices, e.g., A(t1) and A(t2), that is amenable for interpolation of primitive matrices. In such a case the only recourse is to set the interpolation slopes to zero which is essentially equivalent to holding the rendering matrix constant from time t1 to t2, which as already explained might result in a zeroth order discontinuity in the trajectory and the downmix audio waveform at time t2. Details regarding the TrueHD system, and a detailed description of decomposition of specified matrices into primitive matrices, are provided in U.S. Provisional Patent Applications No. 61/984,634, filed Apr. 25, 2014, No. 61/984,292, filed Apr. 25, 2014, and No. 61/883,890, filed Sep. 27, 2013, and herein.

A matrix update point could also be created when two object audio signals (or two separately encoded Atmos TrueHD bitstreams) are "butt spliced," i.e., a connection is made from one object audio signal following a specific matrix trajectory to another object audio signal on a different matrix trajectory. In such a case the discontinuity in the downmix (the rendered version of the spliced signals) could result not only because the object waveforms themselves are discontinuous at the splice point, but also due to the matrix trajectory being discontinuous. It may be possible to fix the discontinuity in the object waveforms by approaches not discussed in this disclosure, in which case the discontinuity in the downmix would solely be a result of the matrix update.

In a class of embodiments, the invention aims to ameliorate the ill effects, of zeroth or higher order discontinuities in a rendering matrix trajectory, on rendered audio signals. An aspect of typical embodiments is to add a linear combination of unscaled correction signals (prototype signals) to each of the rendered signals at a rendering matrix update point (i.e., a short time interval commencing at a rendering matrix update time) so as to correct discontinuities up to a particular order "n" at the matrix update point. It is expected that correction of up to first order discontinuities provides the most benefit, with diminishing returns for correction of higher order discontinuities. Each order of discontinuity is associated with an unscaled correction signal (sometimes referred to herein as a "prototype" signal) that meets certain constraints. One prototype signal per order of discontinuity to be corrected is sufficient, although more can be used.

An example of correction of a zeroth order discontinuity (resulting from a rendering matrix update) in accordance with the invention will be described with reference to FIGS. 2, 3, 4, 5, and 6. In the example, a sequence of rendering matrices $A_i(t)$ is specified over a time interval, where the time interval is a sequence of subintervals, and each subinterval is identified by a different value of the index, i. One rendering matrix update (a transition between consecutive rendering matrices in the sequence) occurs at time "k." This update is a replacement of the matrix $A_i(t)$ for the subinterval prior to time k (to be referred to as "A(k−1)"), by the matrix $A_i(t)$, for the next subinterval (to be referred to as "A(k)").

Comparison of FIGS. 2 and 3 shows the effect of the rendering matrix update at time "k" on one rendered channel. FIG. 2 is a graph of a sequence of rendered audio samples of the channel (which determine a rendered waveform). The rendered samples are generated by applying the time-invariant rendering matrix A(k−1) to input samples. FIG. 3 is a graph of a sequence of rendered audio samples of the audio channel, which have been generated by applying the rendering matrix A(k−1) (the same one applied to generate FIG. 2) to those of the input samples which occur prior to time k, and then applying the updated rendering matrix A(k) to the rest of the input samples (those occurring corresponding to times starting at the time k).

The matrix update results in a visible discontinuity in the rendered waveform (shown in FIG. 3) at time k. An unscaled correction signal (prototype signal) for correcting this zeroth order discontinuity is chosen to be the signal in FIG. 5, which is a short exponentially decaying signal whose initial value (at time k) has unit magnitude. In accordance with an embodiment of the invention, a scaled version of this unscaled correction signal (i.e., the signal of FIG. 5 scaled by a factor "b") is added to the original rendered signal of FIG. 3 to obtain the corrected rendered signal of FIG. 6. As is apparent from FIG. 6, the corrected rendered signal does not have a zeroth order discontinuity at time k.

The scaling factor "b" is determined as follows. A difference signal (shown in FIG. 4) is determined as the difference between the FIG. 2 and FIG. 3 signals, and scaling factor "b" is set to be the value of the difference signal at time k.

The prototype signal of FIG. 5 is an exponentially decaying signal. The rate of decay of the exponential may be chosen so that the value of a sample of the prototype signal after a fixed number of samples (e.g., 4 access units of a TrueHD bitstream=160 samples at a 48 kHz sampling frequency) is 60 dB below the prototype signal's initial sample value (which is equal to 1). Since the rate of decay influences the slope of the corrected signal at time "k", choosing a very fast decay rate may result in a significant change in the first order discontinuity at the same time instant (t=k in the example) and the choice of decay rate may be influenced by the expected (average) first order discontinuity. On the other hand choosing a very slow decay rate may result in deviating from the original uncorrected signal for a long period of time, which means that the artistic intent would be altered to a larger extent than desirable.

Figure 7:
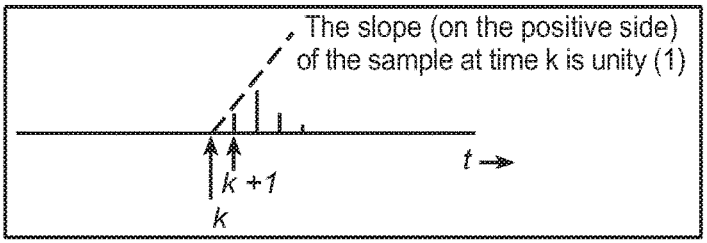
FIG. 7 is a graph of an unscaled correction signal (a "prototype" signal) for correcting a first order discontinuity in a rendered signal (i.e., a first order discontinuity at time k).

Thus, a zeroth order discontinuity of a rendered signal (at a time "k") can be corrected in accordance with an embodiment of the invention, to generate a corrected rendered signal (e.g., by adding the above-described scaled version of the FIG. 5 signal to the FIG. 3 signal to generate the corrected rendered signal of FIG. 6). One can also determine the first order discontinuity (if any exists) of the rendered signal at the same time instant "k" (i.e., the discontinuity in the derivative of the rendered signal at time "k"). A scaled version of a suitable unscaled (prototype) first order correction signal may be added to the corrected rendered signal (in accordance with an embodiment of the invention) to correct the first order discontinuity. Clearly the unscaled first order correction signal itself should not re-introduce a zeroth order discontinuity at time "k". So its first sample has to be zero. Further, the unscaled first order correction signal should have a non-zero slope at its first sample in order to be capable of correcting a first order discontinuity in the rendered signal. FIG. 7 is a graph of an example of an unscaled ("prototype") first order correction signal for correcting a first order discontinuity at a time "k" in a rendered signal (i.e., a first order discontinuity at time "k"). The unscaled first order correction signal of FIG. 7 has a slope equal to one in the interval between time "k" (sample 0 of the unscaled first order correction signal) and the later "time k+1," and its slope then decays back to zero.

In a class of embodiments, the inventive rendering method and system implements zeroth order through "n"th order discontinuity correction at time t (e.g., it implements only zeroth order correction if n=0, and it implements both zeroth order and first order (or just first order) correction if n=1). Each discontinuity which is corrected is a result of an update of a rendering matrix A(t) of the type described with reference to equation (1) above, and the discontinuity correction may be described with reference to the augmented rendering matrix A"(t) of equation (2) below:

$$\underbrace{\begin{bmatrix} y''_0(t) \\ y''_1(t) \\ \vdots \\ y''_{M-1}(t) \end{bmatrix}}_{y''(t)} = \tag{2}$$

$$\underbrace{\begin{bmatrix} a_{00}(t) & a_{01}(t) & a_{02}(t) & \ddots & a_{0,N-1}(t) & b_{0,0} & b_{0,1} & \ddots & b_{0,n} \\ a_{10}(t) & \ddots & \ddots & \ddots & \ddots & b_{1,0} & \ddots & \ddots & \ddots \\ \ddots & \ddots & \ddots & \ddots & \ddots & \ddots & \ddots & \ddots & \ddots \\ a_{M-1,0}(t) & \ddots & \ddots & \ddots & a_{M-1,N-1}(t) & b_{M-1,0} & \ddots & \ddots & b_{M-1,n} \end{bmatrix}}_{A''(t)}$$

-continued $$\underbrace{\begin{bmatrix} x_0(t) \\ x_1(t) \\ x_2(t) \\ \vdots \\ x_{N-1}(t) \\ p_0(t) \\ p_1(t) \\ \vdots \\ p_n(t) \end{bmatrix}}_{x''(t)}$$

The augmented rendering matrix A"(t) of equation (2) is an augmented version of rendering matrix A(t) of equation (1) in the sense that matrix A(t) is identical to the first N columns of matrix A"(t). In equation (2), the augmented input signal vector x"(t) (i.e., an (N+n+1) ×1 matrix, x"(t)), is constructed by concatenating an unscaled correction signal set (of order n) comprising unscaled correction signals $p_0(t), p_1(t), \ldots, p_n(t)$ (which are prototype signals, examples of which were described with reference to FIGS. 5 and 7 above) for up to the required order "n", with the N-element vector x(t) of equation (1) which contains the N audio samples $x_0(t), x_1(t), \ldots, x_{N-1}(t)$ (e.g., from N audio objects) to be rendered. For example, to implement zeroth order discontinuity correction, n=0, and to implement both zeroth order and first order discontinuity correction, n=1.

Typically, each prototype signal $p_i(t)$ itself comprises a sequence of X+1 values (where X is typically a small number), one for each of X successive values of time t (as does the prototype signal of FIG. 5 and the prototype signal of FIG. 7) in the following sense. For a rendering matrix update time, t=k, at which matrix A"(t) is updated, each prototype signal $p_i(t)$ has a predetermined initial value $p_i(k)$, and is applied to the N audio samples $x_0(k), x_1(k), \ldots, x_{N-1}(k)$. For example, the predetermined initial value $p_0(k)$, of the unscaled zeroth order discontinuity correction signal (prototype signal) of FIG. 5, is equal to one. For the next time interval after the matrix update, to be referred to as t=k+1, each prototype signal $p_i(t)$ has a predetermined value $p_i(k+1)$, and is applied to the next set of N audio samples: $x_0(k+1), x_1(k+1), \ldots, x_{N-1}(k+1)$. For the "X"th time after the matrix update, to be referred to as t=k+X, each prototype signal $p_i(t)$ has a predetermined value $p_i(k+X)$, and is applied to the corresponding set of N audio samples: $x_0(k+X), x_1(k+X), \ldots, x_{N-1}(k+X)$.

The elements of the last n+1 columns of matrix A"(t) are correction scaling coefficients $b_{i,j}(t)$, where the index i of each coefficient denotes the relevant row of matrix A"(t), and the index j denotes the order of discontinuity correction for which the coefficient is applied. For example, each of coefficients $b_{i,j}(t)$ is a zeroth order discontinuity correction scaling coefficient as is scaling coefficient "b" of FIG. 4 (i.e., coefficient "b" of FIG. 4, which is applied to scale the unscaled prototype signal of FIG. 5, is an example of any one of coefficients $b_{i,0}(t)$).

In equation (2), the elements of vector y"(t) are the M rendered audio samples (e.g., the values at time t of M speaker feeds) determined by application of matrix A"(t), to the N input audio samples $x_0(t), x_1(t), x_{N-1}(t)$. Determination of the elements of vector y"(t) includes a step of discontinuity correction which is implemented by the matrix multiplication of the augmented input signal vector x"(t) by matrix A"(t).

Typically, the correction scaling coefficients $b_{i,j}$ of equation (2) are themselves piecewise constant, in the sense that they are determined once at each rendering matrix update time (by analysis of the discontinuities introduced by the rendering matrix update) but do not change until the next rendering matrix update time.

It is contemplated that in some implementations, matrix A"(t) is implemented (in a manner described below with reference to equation (3)) as a product of matrices UIV, where V is itself a product of matrices (input matrices) applied at an encoder, I is a row selector matrix applied at a renderer/decoder (of an overall encoding, delivery, and decoding/rendering system), and U is itself a product of matrices (output matrices) also applied at the renderer/decoder. In such implementations, the signal processing operations (e.g., multiplications and additions) performed to implement (i.e., as a result of) matrix multiplication of input signal vector x"(t) by matrix A"(t) consist of a first subset of operations and a second subset of operations. The first subset of operations is performed by the encoder, and the second subset of operations is performed by the renderer/decoder. Thus, the renderer/decoder may not have "knowledge" of (i.e., may not be provided with) the unscaled correction (prototype) signals $p_0(t), p_1(t), \ldots, p_n(t)$, or the correction scaling coefficients $b_{i,j}$. Instead, the renderer/decoder may be provided with only the data values necessary for it to perform the above-mentioned second subset of operations. The purpose of the row selector matrix I indicated above in this paragraph is to specify the specific internal channels of the encoded program to which the decoder must apply U. In cases in which an N-to-N transformation is to be implemented, the decoder will need to apply U to all N internal channels of the encoded program and the row selector matrix will be an identity matrix.

In the typical case that the prototype signals (signals $p_i(t)$ of equation (2)) are predetermined and fixed, a rendering or playback device (e.g., a TrueHD decoder) may simply store a library of these signals (or data values necessary for the rendering or playback device to perform a "second subset" of operations of the type described in the preceding paragraph) and there is no need to actually send the signals (or data values) in the bitstream containing the audio content (e.g., audio objects), and corresponding metadata, to be rendered. However, in some cases the rendering or playback device may already have been deployed and for the purpose of backwards compatibility it may be necessary to transmit the prototype signals (or data values) in the bitstream. For example, the prototype signals may be transmitted in a bitstream (indicative of an object-based program) in the same way as an audio object is transmitted in the bitstream, and the correction scaling coefficients $b_{i,j}(t)$ may be appropriately packaged into the bitstream, either as equivalent spatial metadata or otherwise (e.g., as part of the primitive matrix transport framework in TrueHD).

Any of a variety of different prototype signals may be employed, but the choice as to which prototype signal(s) to employ must abide by relevant constraints. For instance, the first sample of the prototype signal that is mixed (at a rendering matrix update time k in the above examples), to compensate for a zeroth order discontinuity, must have a non-zero value (e.g., as does the first sample of the prototype signal of FIG. 5). However, if compliance with relevant constraints is achieved, the prototype signal(s) can be any signal(s) whose mixing with the input audio has no detrimental audible effect. For instance, an example of a prototype signal for zeroth order discontinuity correction may linearly decay to zero rather than exponentially decay to zero. One could also choose prototype signal(s) that have been designed based on knowledge of the audio to which they will be applied.

In a class of preferred embodiments, the format of the encoded audio (delivered, or to be delivered to a decoder/renderer) is the Atmos version of Dolby TrueHD, and the inventive discontinuity correction is performed to correct zeroth order discontinuities which result from updates of a specified rendering matrix, and which cannot practically be alleviated by interpolation (i.e., generation of interpolated rendering matrices to be applied at times between the updates of the specified rendering matrix). As mentioned earlier, this type of matrix update results in visible, and possible audible, discontinuities in the downmixes obtained from the TrueHD decoder. Especially when the input signals are sinusoidal in nature and there are a large number of frequent piecewise constant matrix updates the audio discontinuities are audible as zipper noise. The preferred embodiments provide a mechanism to address this issue applying (in effect) an augmented rendering matrix A"(t), of the type described with reference to equation (2), to input audio, where the augmented rendering matrix A"(t) is an augmented version of a conventional rendering matrix A(t), and without requiring changes to the gains applied to the audio objects by the portion of the augmented rendering matrix A"(t) which implements the rendering matrix A(t) (i.e., without changing spatial intent).

We next describe one such preferred embodiment, in which the format of the encoded audio program delivered (or to be delivered) to a decoder/renderer is the Atmos version of Dolby TrueHD. As described in above-referenced U.S. Provisional Patent Application No. 61/984,634, filed Apr. 25, 2014 and herein, given samples (e.g., matrices A(t1), A(t2), and A(t3)) of the desired matrix trajectory, the initial design of the input and output primitive matrices, delta (primitive matrix interpolation slope) matrices, and decomposition parameters/segmentation decisions (channel assignments, primitive matrix order sequence, restart intervals, matrix update points, etc.) is agnostic to the magnitude of the discontinuities in the M-channel output mixes that result when the decisions are eventually applied to those of the N input channels which are mixed. In accordance with preferred embodiments of the invention, the initial decisions are, in a second pass, refined based on computation of the discontinuities that result.

Given an initial set of decisions (which determine a sequence of uncorrected rendering matrices to be applied), the uncorrected matrices of the sequence are effectively modified as follows to correct zeroth order discontinuities. Let the time instant t=k be associated with a matrix update, i.e., the updated matrix at time t=k is associated with r input primitive matrices $P_0(k), \ldots, P_{r-1}(k)$ of size N×N, s output primitive matrices $Q^0(k), \ldots, Q_{s-1}(k)$ of size M×M, and input and output channel assignments that define permutation matrices P and Q, respectively, such that the specified updated rendering matrix (a sample of the uncorrected matrix trajectory) is:

$$A(k) = \underbrace{QQ_{s-1}(k)\ldots Q_0(k)}_{U}\, I\, \underbrace{P_{r-1}(k)\ldots P_0(k)P}_{V} \tag{3}$$

In equation (3), I is the M×N row selector matrix. The product of matrices applied at the renderer/decoder (i.e., at the output of an overall encoding, delivery, and decoding/rendering system) is denoted as U in equation (3) and the product of matrices applied at the encoder is denoted by V in equation (3). Row selector matrix I is also applied at the output/decoder. Zeroth order discontinuities typically result (e.g., in rendering of TrueHD encoded programs) from non-interpolated rendering matrix updates, i.e., where the primitive matrices have been held constant from the last time (i.e., time t=k−1) at which they were updated. Let us hypothetically continue the holding of this last matrix update to time "k" from "k−1". This results in a hypothetical rendering matrix A'(k)=A(k−1) which if applied to the audio samples at time "k", will not result in a zeroth order discontinuity at that time. Thus the discontinuities introduced in the M output channels at time "k" can be summarized in the M-element vector:

$$e(k)=(A'(k)-A(k))x(k) \tag{4}$$

In equation (4), x(k) is the set of input audio samples (e.g., from a set of N audio input channels, which are typically object channels) at time k. Assuming that a prototype signal of zeroth order (n=0), e.g., the prototype signal of FIG. 5, with a first value (sample) equal to one at time k has been determined, then e(k) also denotes the gains that should be applied to the prototype signal when the scaled prototype signal is combined with the M output channels to compensate for the discontinuities at time k. In some embodiments, a decoder (e.g., a TrueHD decoder) which is configured to generate an M-channel mix of content of at least some channels of an N-channel encoded program, is also configured in accordance with the invention to mix such a scaled prototype signal (an example of the inventive discontinuity correction signal) with the M output signals, at each matrix update time.

However, we contemplate that it is typically desired that conventional decoders (e.g., conventional TrueHD decoders) be employed to generate M-channel mixes of N-channel encoded audio programs which are generated in accordance with the invention. The conventional decoders may be configured to be capable of generating M-channel mixes of N'-channel encoded audio programs, where N' is greater than N. We have recognized that since such a conventional decoder typically cannot be altered (and is not capable of itself generating the inventive discontinuity correction signal), in order for the conventional decoder to output discontinuity-corrected M-channel mixes, a discontinuity correction signal (enabling discontinuity correction by the conventional decoder) should be embedded in the encoded bitstream (indicative of N encoded audio channels) delivered from the encoder.

We next describe examples of methods and systems for embedding a discontinuity correction signal in an encoded bitstream (e.g., a TrueHD bitstream) indicative of N encoded audio channels.

We first consider the case that the M×M matrix U (of equation (3)) is invertible. This occurs when the specified rendering matrix A(k) is of rank M, where M≤N is implied. In the case that matrix U (of equation (3)) is invertible, adding a scaled prototype signal (discontinuity correction signal) to the M output channels generated by the decoder/renderer (by mixing audio content of at least some of the N channels of the encoded bitstream delivered to the decoder/renderer) is equivalent to adding a differently scaled version of the same prototype signal to those of the internal channels (the N channels indicated by the encoded bitstream) to which U is applied at the decoder/renderer. The scaling coefficients which scale the differently scaled prototype signal are the following gain values:

$$e'(k)=U^{-1}e(k) \tag{5}$$

In equation (5), e(k) is the vector (having M elements) determined by equation (4).

The matrix U applied at the decoder/renderer is conventionally decomposed as a cascade of M×M output primitive matrices $Q_{s-1}(t) \ldots Q_0(t)$, and a permutation matrix Q, i.e., $U=QQ_{s-1}(t) \ldots Q_0(t)$. The matrix V applied at the encoder is conventionally decomposed as a cascade of N×N input primitive matrices $P_{r-1}(t) \ldots P_0(t)$ and a permutation matrix P, i.e. $V=P_{r-1}(t) \ldots P_0(t)P$.

The exemplary embodiment assumes that the encoder is configured to be capable of applying an (N+1)×(N+1) matrix V, decomposed as a cascade of (N+1)×(N+1) extended input primitive matrices and a permutation matrix, to generate an encoded audio program having N+1 encoded audio channels. In the exemplary embodiment, the encoded audio program actually generated includes only N encoded audio channels and one prototype signal in the same slot as an "N+1"th encoded audio channel could have been included.

To apply the discontinuity correction at the encoder in accordance with the exemplary embodiment at an update time t=k, the N×N input primitive matrices $P_{r-1}(k), \ldots, P_0(k)$ are extended to generate extended primitive matrices $P'_{r-1}(k), \ldots, P'_0(k)$, each having size (N+1)×(N+1). The non-trivial row of each extended primitive matrix ($P'_{r-1}(k)$ or . . . or $P'_0(k)$) has one additional element which is a correction scaling coefficient (indicating a multiplication factor for the prototype signal). The prototype signal itself is treated (by the encoder) as an ordinary audio input signal, and may be included (by the encoder) in the encoded bitstream in the same slot as an "N+1"th audio channel would be included, but the prototype signal would typically be ignored by the decoder/renderer during generation of the M-channel mix (of content of all or some of the N channels of the encoded bitstream which actually include audio content). By applying the conventional matrix U (whose elements are also included in the encoded bitstream), a conventional decoder/renderer (e.g., a conventional TrueHD decoder) can obtain the discontinuity-corrected version of the M-channel mix. However, the decoder/renderer would typically discard the recovered prototype signal. In the case that a decoder/renderer operates to losslessly recover all N input audio signals originally input to the encoder, the decoder might apply the conventional matrix U and the prototype signal transmitted in the encoded bitstream to invert the input primitive matrices (applied by the encoder) and recover (losslessly) the original N input audio signals (e.g., object channels).

In the exemplary embodiment, the "prototype signal" is a zeroth order prototype signal (for correcting a zeroth order discontinuity). In variations on the embodiment, at least one other higher order prototype is also employed (to implement "n"th order discontinuity correction), the extended primitive matrices applied at the encoder have size (N+n+1)×(N+n+1), each non-trivial row of each extended primitive matrix has n+1 additional elements (each of which is a correction scaling coefficient for scaling a corresponding prototype signal), and each of the prototype signals may be included in a different slot of the encoded bitstream. For each input audio channel, one prototype signal per order of discontinuity to be corrected is sufficient, although more can be used.

We next describe an example of a method for determining the above-mentioned extended primitive matrices $P'_{r-1}(k), \ldots,$ and $P'_0(k)$, by modifying input primitive matrices. The method includes the following steps:

1. Extend the M-element vector, e"(k), of equation (5) to determine an N-element vector, e"(k) by appending N−M zeros to e"(k);
2. Set h=r−1;
3. Extend the N×N unit primitive matrix $P_h(k)$ to an (N+1)×(N+1) unit primitive matrix $P'_h(k)$ by appending zeros to the right and bottom and setting the new diagonal element (i.e., bottom right corner) to 1;
4. Identify the channel c on which $P_h(k)$ operates, i.e., the index of its non-trivial row. Set the last element of this row to be equal to the element with index c in e"(k);
5. Zero out the element with index c in e"(k);
6. Set $e''(k)=(P_h(k))^{-1}e''(k)$;
7. If h=0, go to step 8, else set h=h-1 and go to step 3;
8. End. The new primitive matrices are the extended primitive matrices $P'_{r-1}(k)$, . . . , and $P'_0(k)$.

In the encoder, the input channel assignment is trivially extended by one element to account for the $(N+1)^{th}$ input channel (the index for the prototype signal continues to be unchanged after the permutation). The prototype signal is then treated like any other internal channel for the purpose of coding into the bitstream.

We next consider the case that the M×M matrix U (of equation (3)) is not invertible. This is always the case when M>N, but could also happen when M≤N, depending on the given A(k). This effectively means that an M-channel downmix at the decoder can be constructed with less than M internal channels of the encoded audio program (which includes N internal channels, where N is greater than M). In this case, an exemplary embodiment includes a step of identifying which of the M channels in the downmix substream are essential to recreate the M-channel downmix and replacing at least one inessential audio channel with the prototype signal. The replaced audio channel may be moved into the next higher substream (which may be the top substream). This reordering of internal channels (of the encoded audio program generated by the encoder) necessitates a non-trivial change in the input channel assignment so that the prototype signal is routed to an internal channel of suitable index so that it will be packed into the appropriate downmix substream (rather than into the top substream). In contrast to the modification of only the input primitive matrices as described above in the exemplary embodiment in which M×M matrix U is invertible, the present exemplary embodiment (in which matrix U is not invertible) typically requires both a modification of the conventional M×M output primitive matrices $Q_{s-1}(k)$ . . . $Q_0(k)$, to generate modified output primitive matrices $Q'_{s-1}(k)$ . . . $Q'_0(k)$, and modification of the conventional N×N input primitive matrices $P_{r-1}(k)$ . . . $P_0(k)$ to generate modified input primitive matrices $P'_{r-1}(k)$, . . . , and $P'_0(k.)$ To apply discontinuity correction to an M-channel mix (generated in a decoder) of audio content of all or some of N channels of an encoded bitstream (generated in an encoder) in accordance with the exemplary embodiment of the previous paragraph at an update time t=k, the encoder and the decoder perform the following steps. The encoder applies the modified input primitive matrices $P'_{r-1}(k)$, . . . , $P'_0(k)$ to an augmented input signal vector x"(t) (of the type described above with reference to equation (2), which includes an unscaled correction signal set of order n, comprising unscaled correction signals (prototype signals) $p_0(t)$, $P_1(t)$, . . . , $p_n(t)$ for up to the required order "n", concatenated with N input audio signals). The encoder generates an encoded audio program including the resulting N encoded audio channels, and the prototype signals, and the modified output primitive matrices $Q'_{s-1}(k)$ . . . $Q'_0(k)$. The decoder then applies the modified output primitive matrices $Q'_{s-1}(k)$ . . . $Q'_0(k)$, to the prototype signals and to some or all of the encoded audio channels of the encoded audio program, to generate a discontinuity-corrected M-channel mix. The combined operations of the encoder and decoder cause the prototype signal set to be appropriately mixed into the channels of the downmix presentation, and cause the discontinuity-corrected M-channel mix to be a discontinuity-corrected version of a conventional M-channel mix which could have been generated in a conventional manner using the conventional M×M output primitive matrices $Q_{s-1}(k)$ . . . $Q_0(k)$, and the conventional N×N input primitive matrices $P_{r-1}(k)$ . . . $P_0(k)$.

In the embodiment of the previous paragraph, the decoder is typically configured to be capable of generating an M-channel mix of a conventional (N+n+1)-channel encoded audio program. The encoded audio program delivered to the decoder includes only N encoded audio channels, and typically also includes the n+1 prototype signal(s) of the unscaled correction signal set in the same slot(s) as n+1 additional encoded audio channel could have been included. The decoder operates on the prototype signal(s) as if they were additional encoded audio channels, when applying the modified output primitive matrices.

With reference again to equation (4), typically extension/modification of primitive matrices and channel assignment steps are initially performed to implement zeroth order discontinuity correction. Then, if it is further desired that first order discontinuities be addressed as well, then the process of extension/modification of primitive matrices and channel assignment is repeated but with a new e(k) vector that now indicates the desired gains to be applied to a second prototype signal used for correction of the first order derivative at the update time k.

In either the above-described case that matrix U is invertible or the above-described case that U is not invertible, each prototype signal is typically included as one of the channels (internal channels) in the encoded bitstream. The index of the prototype signal in the list of internal channels is different in the case that U is invertible than it is in the case that U is non-invertible. A TrueHD bitstream can be received by either:

(a) a decoder which operates to reconstruct losslessly all the input waveforms (all N input signals originally input to the encoder). An example of such a decoder is an Atmos TrueHD decoder that operates to retrieve N input objects in a bit-exact manner; or (b) a decoder (typically a legacy decoder) which operates to construct an M-channel downmix of the N input signals originally input to the encoder.

The TrueHD decoder in either case, (a) or (b), does not distinguish whether internal channels are true audio channels (e.g., audio objects) or prototype signal(s), and simply applies the primitive matrices it receives to the internal channels it is concerned with to produce the decoded waveforms.

In case (b), the decoded waveforms are speaker feeds that are simply routed to specific speakers. The decoder need not identify whether any of the internal channels it accessed were prototype signals.

However, in case (a), the decoded waveforms include both true audio channels (e.g., audio objects) and also prototype signals (typically determined by data residing in slots of the encoded bitstream which are not used to indicate audio channels). A TrueHD bitstream can have up to a maximum of 16 such slots, so that the number of audio channels (e.g., audio objects) indicated by the bitstream plus the number of prototype signals indicated by the bitstream can be 16 or less. Typically, the encoder essentially treats the prototype signals in the same way as normal audio channels (e.g., audio objects) with regard to packaging them into the encoded bitstream. During rendering of each audio object, associated metadata in the bitstream (a different subset of the metadata is associated with each object) is used by an object audio renderer (implemented downstream of the decoder) to convert the objects to speaker feeds for playback. Thus, it is contemplated that in some embodiments, prototype signals (that are transmitted in slots normally used to transmit objects) are associated with metadata indicative of an "ignore" flag, which directs the renderer to simply discard these signals when generating speaker feeds in response to the objects in the TrueHD bitstream. In such embodiments, the TrueHD decoder is thus helped by the encoder to identify superfluous signals (e.g., prototype signals) in the bitstream.

Typical embodiments of the invention (which encode and decode bitstreams in the TrueHD format) require only an encoder update. In such embodiments, a conventional TrueHD decoder can operate in the same way on either a conventional bitstream or a bitstream generated in accordance with the invention (regardless of whether it renders all channels, e.g., object channels, of the encoded bitstream or a downmix presentation of the channels). When matrix U is invertible, only the unit input primitive matrices (applied by the encoder) need be modified. In this case modified primitive matrices are received in the bitstream only by a lossless decoder (i.e., by a decoder which operates to reconstruct losslessly all N input signals originally input to the encoder) and not by a decoder (typically a legacy decoder) which operates to construct an M-channel downmix of the N input signals originally input to the encoder. When matrix U is not invertible, both the input and the output primitive matrices may need to be modified, and modified primitive matrices may be received in the encoded bitstream and applied by both a decoder which operates to reconstruct losslessly all N input signals originally input to the encoder) and a decoder which operates to construct an M-channel downmix of the N input signals originally input to the encoder.

Note that the description of some embodiments (e.g., some embodiments which encode and/or decode and render bitstreams in the TrueHD format) is in the context of a single downmix of a set of input audio signals (e.g., audio objects). The format of a TrueHD bitstream provides a hierarchical structure to carry an entire cascade of downmixes. For instance, a single TrueHD bitstream may be used to derive a 7.1 ch downmix of N-channel Atmos input, a 5.1 ch downmix of this 7.1 ch downmix, and a 2 ch downmix of this 5 ch downmix. In this case a 2 channel decoder accesses only the first 2 internal channels among the N internal channels to create the stereo downmix of the objects. The 5.1 ch decoder accesses the first 6 internal channels and the 7.1ch downmix accesses the first 8 internal channels. In accordance with typical embodiments of the invention, the bitstream carries separate sets of output primitive matrices to construct each of these downmixes. An algorithm described herein may be first used to modify the primitive matrices to correct a discontinuity in the 7.1 ch downmix, and then a suitable augmentation of the algorithm may be used sequentially in the context of the 5.1 ch and stereo downmixes to further modify the primitive matrices (e.g., so that all three downmixes are continuous in their waveforms).

Figure 8:
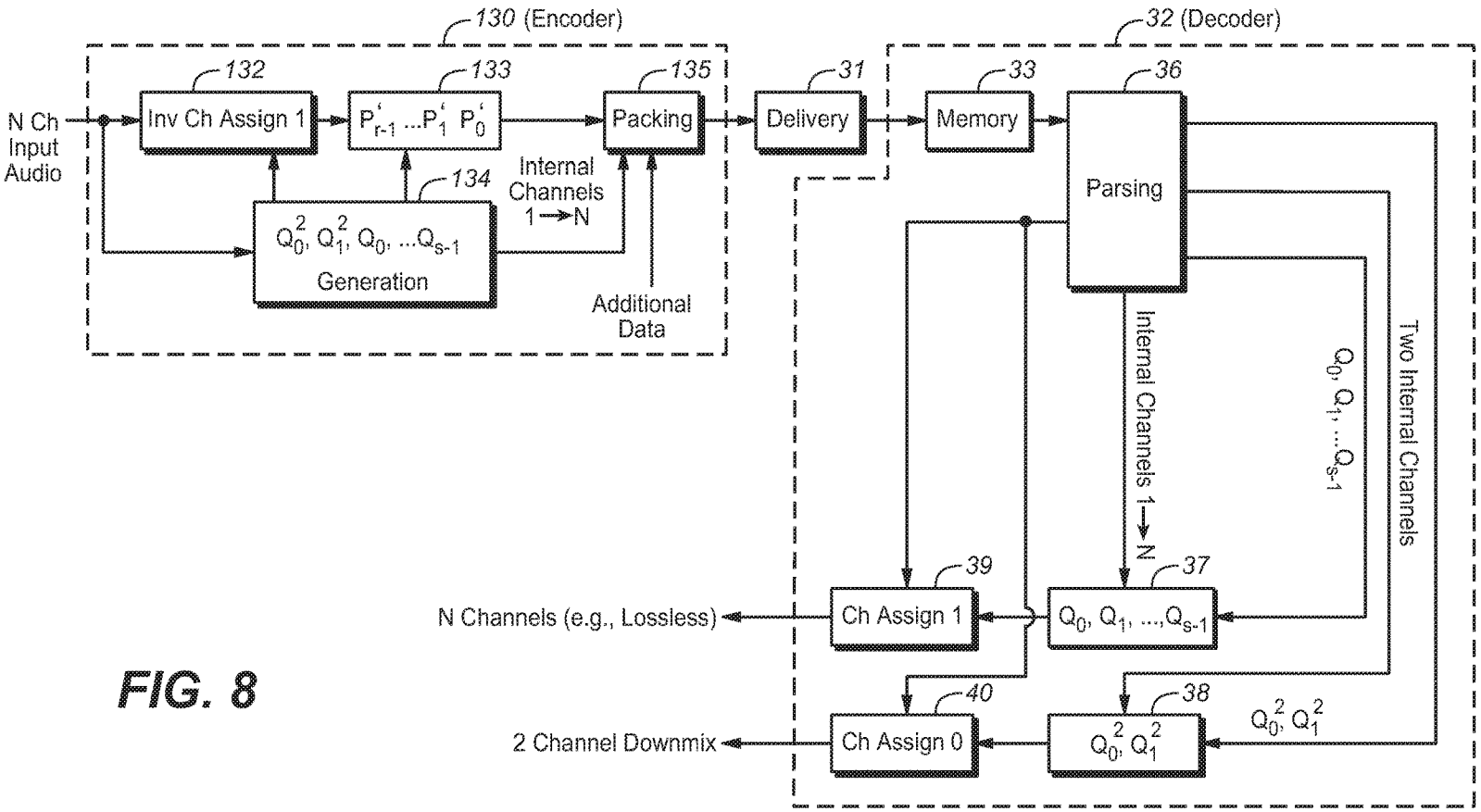
FIG. 8 is a block diagram of an embodiment of the inventive system including an embodiment of the inventive encoder, a delivery subsystem, and an embodiment of the inventive decoder.

FIG. 8 is a block diagram of an embodiment of the inventive audio data processing system which includes encoder 130 (an embodiment of the inventive encoder), delivery subsystem 31 (which may be identical to delivery subsystem 31 of FIG. 1), and decoder 32 (which may be identical to decoder 32 of FIG. 1), coupled together as shown. Although subsystem 32 is referred to herein as a "decoder" it should be understood that may be implemented as a playback system including a decoding subsystem (configured to parse and decode a bitstream indicative of an encoded multichannel audio program) and other subsystems configured to implement rendering and at least some steps of playback of the decoding subsystem's output. Some embodiments of the invention are decoders which are not configured to perform rendering and/or playback (and which would typically be used with a separate rendering and/or playback system). Some embodiments of the invention are playback systems (e.g., a playback system including a decoding subsystem and other subsystems configured to implement rendering and at least some steps of playback of the decoding subsystem's output).

In the FIG. 8 system, encoder 130 is configured to encode up to N' (e.g., N'=8 or N'=16) audio input signals (sometimes referred to herein as input channels, e.g., input channels which are object channels and/or speaker channels of an audio program) as an encoded bitstream including two substreams (one indicative of an N'-channel audio program), and decoder 32 is configured to decode the encoded bitstream to render either the N'-channel program or a 2-channel downmix of the N'-channel program. The N'-channel audio program can be a linear transformation (mix) of content of the N' input signals. Or, the N'-channel audio program can be identical to the N' input signals, in which case decoder 32 is typically configured to decode the encoded bitstream and to render either the original N' input signals (losslessly) or the downmix.

Encoder 130 is coupled and configured to generate the encoded bitstream and to assert the encoded bitstream to delivery system 31.

As will be explained below, one or more of the N' slots (available for encoded audio content) in the encoded bitstream are typically used in accordance with embodiments of the invention to contain data indicative of unscaled correction signal(s) (sometimes referred to herein as "prototype" signal(s)), so that encoder 130 operates to encode only N (where N is less than N') audio input signals. Thus, the number of audio channels (e.g., object channels) indicated by the encoded bitstream (which is output from encoder 130), plus the number of prototype signals indicated by the encoded bitstream, can be N' or less. Thus, the encoded bitstream can be indicative of an N-channel audio program which is a linear transformation (mix) of content of the N input signals. Or, the encoded bitstream can be indicative of the N input signals, in which case decoder 32 is typically configured to decode the encoded bitstream and to render the original N input signals (losslessly).

For example, in implementations in which encoder 130 is configured to encode the audio input channels in accordance with the Atmos Dolby TrueHD format, the input audio channels can be or include object channels and/or speaker channels, decoder 32 is configured to decode and render the encoded bitstream output from encoder 130, and N'=16. However, as will be explained below, some (e.g., one) of the sixteen available slots in the bitstream are typically used in accordance with embodiments of the invention to contain data indicative of unscaled correction signal(s), so that encoder 130 operates to encode fewer than 16 (e.g., N=8) input audio channels. Thus, in these implementations the number of audio channels (e.g., object channels) indicated by the encoded bitstream, plus the number of prototype signals indicated by the encoded bitstream, can be 16 or less.

Delivery system 31 is coupled and configured to deliver (e.g., by storing and/or transmitting) the encoded bitstream to decoder 32. In some embodiments, system 31 implements delivery of (e.g., transmits) an encoded multichannel audio program over a broadcast system or a network (e.g., the internet) to decoder 32. In some embodiments, system 31 stores an encoded multichannel audio program in a storage medium (e.g., a disk or set of disks), and decoder 32 is configured to read the program from the storage medium.

Block 132 (labeled "InvChAssign1") in encoder 130 is configured to perform channel permutation (equivalent to multiplication by a permutation matrix) on the N channels of input audio. The permutated channels then undergo encoding in stage 133, which outputs N encoded signal channels. The encoded signal channels may (but need not) correspond to playback speaker channels. The encoded signal channels are sometimes referred to as "internal" channels since a decoder (and/or rendering system) typically decodes and renders the content of the encoded signal channels to recover the input audio (or a mix of content of the input audio signals), so that the encoded signal channels are "internal" to the encoding/decoding system.

In variations on the FIG. 8 embodiment, an encoder is configured to encode N audio input channels as an encoded bitstream including any number of substreams (e.g., a top substream indicative of all the encoded channels of the encoded bitstream, and any number of downmix substreams, each downmix substream comprising a different subset of the encoded audio channels of the encoded bitstream), and a decoder is configured to decode the encoded bitstream and to render either an N-channel program indicated by the encoded bitstream (e.g., the original N input signals, in which case the decoder is typically configured to losslessly recover and render the original N input signals) or one or more M-channel mixes (i.e., M output channels), where M is any number. In the FIG. 8 embodiment, M=2. In general, any of the M-channel mixes can be a downmix (when M is less than N) or an upmix (when M is greater than N) of content of the original N input channels, or N can equal M.

In accordance with typical embodiments of the invention, the combination of encoding N audio input channels (e.g., in encoder 130), and decoding/rendering (e.g., in decoder 32) the encoded channels to generate M output channels (e.g., M=2 or M=N in the specifically described implementation of FIG. 8), has the effect of performing matrix multiplication on the N input signals by an augmented rendering matrix A"(t) having form as shown in equation (2).

In typical embodiments (e.g., embodiments in which the encoded bitstream has the TrueHD format), the matrix A"(t) is implemented (in a manner described herein with reference to equation (3)) as a product of matrices UIV, where V is itself a product of matrices (input matrices) applied at the encoder, I is a row selector matrix applied at a renderer/decoder (of an overall encoding, delivery, and decoding/rendering system), and U is itself a product of matrices (output matrices) also applied at the renderer/decoder. In the FIG. 8 embodiment, the encoding performed in elements 132 and 133 of encoder 130 is equivalent to multiplication of each set of N input samples (corresponding to one time in an audio program) by such a matrix V, and the decoding/rendering performed in elements 37 and 39 (or elements 38 and 40) of decoder 32 is equivalent to multiplication of each set of N samples of the encoded bitstream (corresponding to one time in the audio program) by matrices UI.

More specifically, the matrix V is typically decomposed into a product (cascade) of matrices of form $V(t)=P_{r-1}(t) \ldots P_0(t)P$, and the product of matrices UI is typically decomposed into a product (cascade) of matrices of form $U(t)I(t)=QQ'_{s-1}(t) \ldots Q_0(t)\ I$, as described herein with reference to equation (3), where each of the r matrices $P_{r-1}(t), \ldots, P_0(t)$ is a primitive matrix of size N×N, each of the s matrices $Q_{s-1}(t), \ldots, Q_0(t)$ is a primitive matrix of size M×M, permutation matrices P and Q determine input and output channel assignments, respectively, and I is an M×N row selector matrix. In the FIG. 8 embodiment, element 132 applies permutation matrix P, and element 133 applies a cascade of primitive matrices $P_{r-1}(t) \ldots P_0(t)$, which are labeled as $P'_{r-1}(t) \ldots P'_0(t)$ in FIG. 8 to indicate that they are determined in accordance with the invention and are not conventional matrices. Also in the FIG. 8 embodiment, elements 37 and 39 are configured to apply a first cascade of matrices of form $QQ_{s-1}(t) \ldots Q_0(t)I$, with element 39 applying the permutation matrix Q thereof and element 37 applying $Q_{s-1}(t) \ldots Q_0(t)I$, with I being the N×N identity matrix, and elements 38 and 40 are configured to apply a different cascade of matrices of form $QQ_{s-1}(t) \ldots Q_0(t)I$, with element 38 applying the permutation matrix Q thereof and element 40 applying $Q_{s-1}(t) \ldots Q_0(t)I$, with I being the 2×N row selector matrix, and $Q_{s-1}(t) \ldots, Q_0(t)$ comprising two primitive matrices labeled as $Q^2{}_1(t)$ and $Q^2{}_0(t)$.

In the FIG. 8 embodiment, the combined operation of encoder 130 and elements 36, 37, and 39 of decoder 32 has the effect of performing matrix multiplication on the N input signals (and a prototype signal set of order n, comprising unscaled correction signals $p_0(t), p_1(t), \ldots, p_n(t)$ of the type described above with reference to equation (2)) by a first augmented rendering matrix A"(t), to generate N output signals. The combined operation of encoder 130 and elements 36, 38, and 40 of decoder 32 has the effect of performing matrix multiplication on the N input signals (and a prototype signal set of order n, comprising unscaled correction signals $p_0(t), p_1(t), \ldots, p_n(t)$ of the type described above with reference to equation (2)) by a second augmented rendering matrix A"(t), to generate a downmix presentation comprising two output signals. The encoded bitstream output from encoder 130 has two substreams: one substream (i.e., a top substream) employed to generate the N-channel output of element 39 of decoder 32, and another substream employed to generate the 2-channel output of element 40 of decoder 32.

As noted, in variations on the FIG. 8 embodiment, an encoder is configured to encode N audio input channels as an encoded bitstream including any number of substreams, and a decoder is configured to decode the encoded bitstream and to render either an N-channel program indicated by the encoded bitstream (e.g., the original N input signals, in which case the decoder is typically configured to losslessly recover and render the original N input signals) or one or more M-channel mixes, where M is greater than N or less than N. For example, in one such variation, the encoder is a modified version of encoder 130 of FIG. 8 which encodes N audio input channels as an encoded bitstream including three substreams (a top substream indicative of all the encoded channels of the encoded bitstream, a first downmix substream, and a second downmix substream), and includes (in the encoded bitstream) metadata indicative of three different output primitive matrix cascades (each for rendering a different one of the substreams. In the example, the decoder is configured to decode the encoded bitstream and: apply a first one of the output primitive matrix cascades (which could consist of matrices $Q_{s-1}(t) \ldots Q_0(t)$ applied by element 37 of FIG. 8) to render an N-channel program indicated by the top substream; and/or apply a second one of the output primitive matrix cascades (which could consist of matrices $Q^2_1(t)$ and $Q^2_0(t)$ applied by element 38 of FIG. 8) to render a 2-channel mix of content of the first downmix substream (which could consist of two encoded audio channels of the encoded bitstream); and/or a third one of the output primitive matrix cascades (which could consist of M matrices, where M is less than N but not equal to 2) to render an M-channel mix of content of the second downmix substream (which could consist of M encoded audio channels of the encoded bitstream).

With reference to encoder stage 133 of FIG. 8, the input primitive matrix cascade $P'_{r-1}(t) \ldots P'_0(t)$ applied by stage 133 is determined in subsystem 134, and is updated from time to time (typically infrequently) in accordance with a specified time-varying mix of the program's N channels to N encoded signal channels.

Matrix determination subsystem 134 is configured to generate data indicative of the coefficients of two sets of output matrices (each of the sets corresponding to a different substream of the encoded channels). Each set of output matrices is updated from time to time, so that the coefficients are also updated from time to time. One set of output matrices consists of two rendering matrices, $Q^2_0(t)$, $Q^2_1(t)$, each of which is a primitive matrix of dimension 2×2, and is for rendering a first substream (a downmix substream) comprising two of the encoded audio channels of the encoded bitstream (to render a two-channel downmix of the N-channel input audio). The other set of output matrices consists of rendering matrices, $Q_0(t), Q_1(t), \ldots, Q_{s-1}(t)$, each of which is a primitive matrix (preferably a unit primitive matrix, if lossless reconstruction is desired), and is for rendering a second substream (a top substream) comprising all N of the encoded audio channels of the encoded bitstream (for recovery of a full N-channel audio program). For each time, t, a cascade of the rendering matrices, $Q^2_0(t)$, $Q^2_1(t)$, with the input matrices applied by subsystem 133 and permutation matrices (described elsewhere herein), can be interpreted as a rendering matrix for the channels of the first substream that renders the two channel downmix from the two encoded signal channels in the first substream, and similarly a cascade of the rendering matrices $Q_0(t)$, $Q_1(t)$, . . . , $Q_{s-1}(t)$, with the input matrices applied by subsystem 133 and permutation matrices (described elsewhere herein), can be interpreted as a rendering matrix for the channels of the second substream.

The coefficients (of each rendering matrix) that are output from subsystem 134 to packing subsystem 135 are metadata indicating relative or absolute gain of each channel to be included in a corresponding mix of channels of the program. The coefficients of each rendering matrix (for an instant of time during the program) represent how much each of the channels of a mix should contribute to the mix of audio content (at the corresponding instant of the rendered mix) indicated by the speaker feed for a particular playback system speaker.

The N encoded audio channels (output from encoding stage 133), the output matrix coefficients (generated by subsystem 134), and typically also additional data are asserted to packing subsystem 135, which assembles them into the encoded bitstream which is then asserted to delivery system 31.

An example of such additional data is a prototype signal set of order n. In a typical implementation of stage 133, an augmented input signal vector x"(t) (i.e., an (N+n+1)×1 matrix, x"(t) of the type described with reference to equation (2)) is constructed by concatenating an unscaled correction signal set of order n (also referred to as a prototype signal set of order n) comprising unscaled correction signals $p_0(t)$, $p_1(t), \ldots, p_n(t)$ (which are prototype signals, examples of which are described herein with reference to FIGS. 5 and 7) for up to the required discontinuity correction order "n", with an N-element vector x(t) comprising the N audio samples $x_0(t), x_1(t), \ldots, x_{N-1}(t)$ (e.g., from N audio objects) to be encoded. Stage 133 applies the input primitive matrix cascade $P'_{r-1}(t) \ldots P'_0(t)$ to the augmented input signal vector to generate the N encoded audio signals which are included (by subsystem 135) in the encoded bitstream. Typically, subsystem 135 also includes the prototype signal set in the encoded bitstream. For example, each of the n+1 prototype signals of the set can be included in a different slot of the encoded bitstream in which subsystem 135 could have included an additional encoded audio channel (an encoded audio channel in addition to the N encoded audio channels which are included in the encoded bitstream).

Typically, the input matrices applied by subsystem 133 (and optionally also, at least some of the output matrices asserted by stage 134 to subsystem 135 for inclusion in the encoded bitstream output from the encoder) include elements indicative of correction scaling coefficients $b_{i,j}(t)$, of the type described with reference to equation (2). Linear combinations of the correction scaling coefficients and values of the above-mentioned prototype signal(s) determine discontinuity correction values which are employed to implement discontinuity correction at rendering update times (equivalent to the discontinuity correction described with reference to equation (2)) in accordance with embodiments of the invention.

The encoded bitstream output from encoder 130 thus includes data indicative of the N encoded audio channels, the two sets of time-varying output matrices (one set corresponding to each of two substreams of the encoded channels), and typically also additional data (e.g., a prototype signal set and/or other metadata regarding the audio content of the bitstream).

Figure 9:
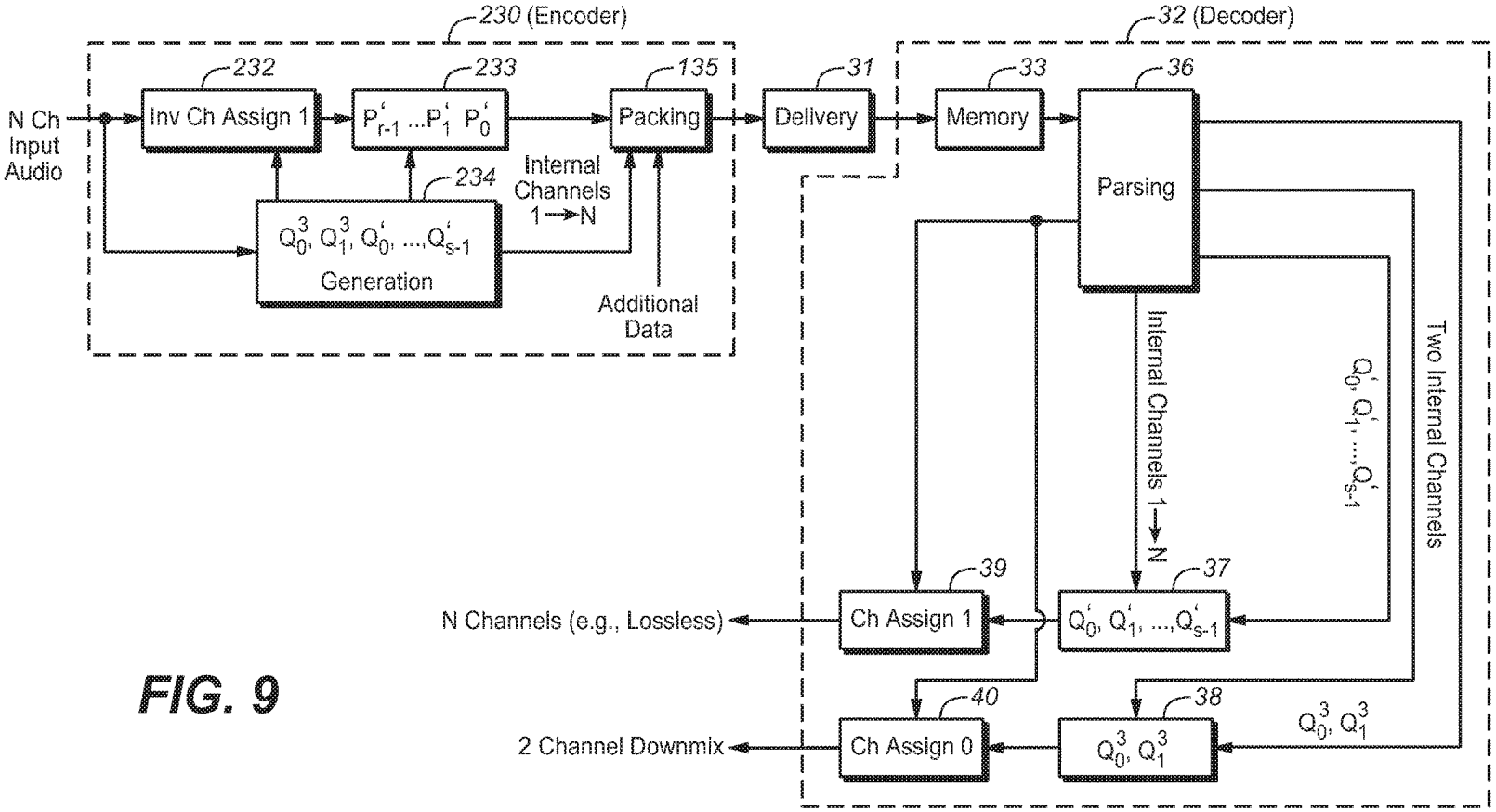
FIG. 9 is a block diagram of another embodiment of the inventive system including an embodiment of the inventive encoder, a delivery subsystem, and an embodiment of the inventive decoder.

In typical operation of encoder 130 (and some other embodiments of the inventive encoder, e.g., encoder 230 of FIG. 9), it is assumed that a sequence of rendering matrices, $A_i$, has been specified over a time interval (where the time interval is a sequence of subintervals, and each of the subintervals is identified by a different value of an index, i) for rendering audio content of at least some of the N audio input signals, where transitions between matrices of the sequence of rendering matrices occur at update times. In such operation, encoder 130 (or another embodiment of the inventive encoder, e.g., encoder 230 of FIG. 9) generates an encoded audio program input signal, including by:

(a) encoding the N audio input signals (e.g., N signals indicative of N channels of an object-based audio program or another audio program) as N channels of encoded audio content, in accordance with the sequence of rendering matrices;

(b) determining discontinuity correction values (e.g., in subsystem 134 of FIG. 8), for application to encoded audio content of at least some of the N channels at (e.g., for an interval of short duration commencing at) at least one of the update times, to implement discontinuity correction at said at least one of the update times; and (c) generating the encoded audio program to include N channels of discontinuity-corrected, encoded audio content (e.g., the output of subsystem 133 of FIG. 8), including by applying at least some of the discontinuity correction values to the encoded audio content of at least some of the N channels.

In some implementations, step (c) includes a step of generating the encoded audio program to be indicative of at least some of the discontinuity correction values (e.g., the discontinuity correction values include a prototype signal set of order n, where n is an integer indicative of an order of discontinuity correction, and the encoded audio program is generated to be indicative of the prototype signal set).

In implementations, the discontinuity correction values include values which determine a prototype signal set (e.g., a predetermined prototype signal set, which is stored in encoder 130, for application by subsystem 133 of FIG. 8) of order n, where n is an integer indicative of an order of discontinuity correction, and both the encoding of the N audio input signals as N channels of encoded audio content, and the application of said at least some of the discontinuity correction values to the encoded audio content of at least some of the N channels, are implemented by performance of a matrix multiplication (e.g., multiplication by input primitive matrix cascade $P'_{r-1}(t) \ldots P'_0(t)$ in subsystem 133 of FIG. 8) on data indicative of a vector whose elements are a sequence of the N audio input signals and the prototype signal set.

In some implementations, step (b) includes steps of:

determining a prototype signal set (e.g., by accessing a predetermined prototype signal set, which is stored in encoder 130, for application by subsystem 133 of FIG. 8) of order n, where n is an integer indicative of an order of discontinuity correction (e.g., when, n=0, the prototype signal set consists of a single prototype signal, $p_0(t)$, of a type described herein. For another example, when n=1, the prototype signal set consists of a zeroth order discontinuity correction prototype signal, $p_0(t)$, and a first order discontinuity correction prototype signal, $p_1(t)$. Alternatively, if n is greater than or equal to 1, the prototype signal set could consist of just one prototype signal, e.g., $p_1(t)$ (e.g., if there is no zeroth order discontinuity at the relevant update time) or $p_2(t)$ (e.g., if there is no zeroth order or first order discontinuity at the relevant update time)); and determining correction scaling coefficients (e.g., coefficients $b_{i,j}(t)$, of a type described herein, which are indicated by elements of input primitive matrix cascade $P'_{r-1}(t) \ldots P'_0(t)$ of FIG. 8) such that application of the prototype signal set, scaled by the correction scaling coefficients, to the encoded audio content of the at least some of the N channels (e.g., accomplished by matrix multiplication in subsystem 133 of FIG. 8) at said at least one of the update times, implements the discontinuity correction at said at least one of the update times. Optionally, step (c) also includes a step of including (e.g., by operation of subsystem 135 of FIG. 8) the prototype signal set in the encoded audio program (e.g., in segments ("slots") which could otherwise include additional channels of encoded audio content).

With reference to stage 134 of FIG. 8, each set of output matrices (set $Q^2_0(t)$, $Q^2_1(t)$, or set $Q_0(t), Q_1(t), \ldots, Q_{s-1}(t)$) is updated from time to time. A first set of output matrices $Q^2_0(t\mathbf{1})$, $Q^2_1(t\mathbf{1})$, that is output (at a first time, t1) determines, with the input matrices applied by subsystem 133 and the appropriate permutation matrices, a linear transformation to be performed at the first time during the program (on samples of two channels of the encoded bitstream output from encoder 130, corresponding to the first time). The other set of output matrices $Q_0(t\mathbf{1}), Q_1(t\mathbf{1}), \ldots, Q_{s-1}(t\mathbf{1})$ that is output (at first time, t1) determines, with the input matrices applied by subsystem 133 and the appropriate permutation matrices, another linear transformation to be performed at the first time during the program (i.e., on samples of all N channels of the encoded bitstream output from encoder 130, corresponding to the first time).

With reference to decoder 32 of FIG. 8, memory 33 (which may be a buffer memory) is coupled and configured to store, in non-transient manner, at least one segment of an encoded bitstream (an encoded audio program) delivered to decoder 32. This program may include N channels of discontinuity-corrected, encoded audio content (i.e., it will include such N channels of discontinuity-corrected, encoded audio content if it has been generated by encoder 130 in accordance with an embodiment of the invention), and may also include data indicative of discontinuity correction values (e.g., a prototype signal set of order n, of a type described herein).

Parsing subsystem 36 (of decoder 32) is coupled and configured to parse the encoded bitstream accepted (read or received) by decoder 32 from delivery system 31 and to parse the encoded bitstream. Subsystem 36 is operable to assert the substreams of the encoded bitstream (including a "first" substream comprising only two encoded channels of the encoded bitstream), and output matrices $Q^2_1(t)$ and $Q^2_0(t)$ corresponding to the first substream, to matrix multiplication stage 38 (for processing which results in a 2-channel downmix presentation of content of the full N-channel program indicated by the bitstream). Subsystem 36 is also operable to assert the substreams of the encoded bitstream (a "top" substream comprising all N encoded channels of the encoded bitstream), and corresponding output matrices $Q_{s-1}(t) \ldots Q_0(t)$ to matrix multiplication stage 37 for processing which results in reproduction of a full N-channel program indicated by the encoded bitstream.

Parsing subsystem 36 of FIG. 8 (or FIG. 9) may include (and/or implement) additional lossless encoding and decoding tools (for example, LPC coding, Huffman coding, and so on).

Stage 38 multiplies two audio samples of the two channels (of the encoded bitstream) which correspond to the channels of the first substream by the most recently updated cascade of the matrices $Q^2_1(t)$ and $Q^2_0(t)$, and each resulting set of two linearly transformed samples undergoes channel permutation (equivalent to multiplication by a permutation matrix) in element 40 to yield each pair of samples of the required 2 channel downmix of the full set of N audio channels indicated by the encoded bitstream. The cascade of matrixing operations performed in encoder 130 and elements 38 and 40 of decoder 32 is equivalent to application of a downmix matrix specification that transforms the N input audio channels to the 2-channel downmix.

Stage 37 multiplies each vector of N audio samples (one from each of the full set of N audio channels of the encoded bitstream) by the most recently updated cascade of the matrices $Q_{s-1}(t) \ldots Q_0(t)$ and each resulting set of N linearly transformed samples undergoes channel permutation (equivalent to multiplication by a permutation matrix) in element 39 to yield each set of N samples of the recovered N-channel program indicated by the encoded bitstream.

When the N-channel program indicated by the encoded bitstream is identical to the original N input signals asserted to encoder 130, the cascade of matrixing operations performed in encoder 130 and elements 37 and 39 of decoder 32 is equivalent to application of a rendering matrix that recovers losslessly the original N input signals encoded by encoder 130, i.e., an identity matrix.

Permutation stage 39 of decoder 32 applies to the output of stage 37 the required channel permutation (e.g., in the case of lossless retrieval, the inverse of the channel permutation applied by encoder 30, i.e., the permutation matrix "ChAssign1" represented by stage 39 of decoder 32 is the inverse of that "InvChAssign1" represented by element 132 of encoder 130).

In variations on subsystems 130 and 32 of the system shown in FIG. 8, one or more of the elements are omitted or additional audio data processing units are included.

Encoder 130 of FIG. 8 implements discontinuity correction in accordance with an embodiment in the class described above, in which output matrix U applied at the decoder/renderer (i.e., decoder 32 of FIG. 8) is invertible. In the FIG. 8 embodiment, decoder 32 does not itself implement discontinuity correction (though it may apply a prototype signal set, included in the encoded bitstream delivered by subsystem 31, in accordance with an aspect of the invention), and the output matrix U is a output matrix (which does not implement discontinuity correction), which is conventionally decomposed as a cascade of output primitive matrices $Q_{s-1}(t) \ldots Q_0(t)$, and a permutation matrix Q, i.e., $U=QQ_{s-1}(t) \ldots Q_0(t)$. It should be understood, that in the case that the output of subsystem 39 is a lossless reconstruction of the N input signals asserted to encoded 130, the output primitive matrices applied by subsystem 37 are the inverses of the input primitive matrices applied by subsystem 133 of the encoder. Since the input primitive matrices have been altered according to an embodiment of the invention to implement discontinuity correction, the output primitive matrices are naturally also affected (in the sense that they are not identical to the conventional output primitive matrices that the decoder would have applied if the encoder had not implemented discontinuity correction).

In FIG. 8, the primitive matrices $Q^2{}_1(t)$ and $Q^2{}_0(t)$, included in the encoded bitstream delivered to decoder 32, are an example of the conventional cascade of primitive matrices (which are a decomposition of a conventional output matrix U), and the primitive matrices $Q_{s-1}(t), \ldots, Q_0(t)$, also included in the encoded bitstream delivered to decoder 32, are another example of a cascade of primitive matrices (which are a decomposition of an output matrix U).

In the FIG. 8 embodiment, the cascade of primitive matrices $P'_{r-1}(t) \ldots P'_0(t)$ applied by subsystem 133 of encoder 130 is an example of the inventive cascade of extended primitive matrices (described above). The input matrix V applied by encoder 130 is decomposed as a cascade of the extended primitive matrices $P'_{r-1}(t) \ldots P'_0(t)$ and a permutation matrix P, i.e. $V=P'_{r-1}(t) \ldots P'_0(t)P$. Each of the extended primitive matrices $P'_{r-1}(t) \ldots P'_0(t)$ has size greater than N×N. Subsystem 133 applies the cascade of primitive matrices $P'_{r-1}(t) \ldots P'_0(t)$ to implement discontinuity correction.

In contrast, encoder 230 and decoder 32 of FIG. 9 may both implement discontinuity correction, in accordance with an embodiment in the class described above, in which output matrix U applied at the decoder/renderer (before the inventive modification) is not invertible. In the FIG. 9 embodiment, decoder 32 may implement discontinuity correction, and the modified output matrix U is an example of the inventive output matrix which is decomposed as a cascade of output primitive matrices and a permutation matrix Q, e.g., $U=QQ'_{s-1}(t) \ldots Q'_0(t)$, or $U=QQ^3{}_1(t)Q^3{}_0(t)$. In FIG. 9, the primitive matrices $Q^3{}_1(t)$ and $Q^3{}_0(t)$, included in the encoded bitstream delivered to decoder 32, are an example of the inventive output matrix U (which may implement discontinuity correction when it is applied by element 38 in operation of decoder 32 of FIG. 9). The primitive matrices $Q'_{s-1}(t), \ldots, Q'_0(t)$, also included in the encoded bitstream delivered to decoder 32 of FIG. 9, are another example of the inventive output matrix U (which may implement discontinuity correction when it is applied by element 37 in operation of decoder 32 of FIG. 9).

In the FIG. 9 embodiment, the cascade of primitive matrices $P'_{r-1}(t) \ldots P'_0(t)$ applied by subsystem 233 of encoder 230 is an example of the inventive cascade of extended primitive matrices (described above). The input matrix V applied by encoder 230 is decomposed as a cascade of the extended primitive matrices $P'_{r-1}(t) \ldots P'_0(t)$ and a permutation matrix P, i.e. $V=P'_{r-1}(t) \ldots P'_0(t)P$. Subsystem 233 applies the cascade of primitive matrices $P'_{r-1}(t) \ldots P'_0(t)$ to implement discontinuity correction. Subsystem 232 of FIG. 9 may implement different channel permutation (equivalent to multiplication by a permutation matrix) on the N channels of input audio asserted to encoder 230 than the permutation implemented by subsystem 132 of FIG. 8 on the N channels of input audio asserted to encoder 130.

All elements of the FIG. 9 system which are identified by reference numerals identical to those of the FIG. 8 system correspond to (and operate in the same way as) the identically referenced elements of FIG. 8, and the description thereof with reference to FIG. 8 will not be repeated. The differences between the FIG. 8 and FIG. 9 systems have been explained in the previous paragraphs.

Another aspect of the invention is a rendering system. We next describe embodiments of such a rendering system with reference to FIG. 10. The rendering system of FIG. 10 includes rendering subsystem 51, which is coupled to receive N audio signals and configured to generate M discontinuity-corrected audio signals in response to at least some of the N audio signals and a prototype signal set of order n, where n is an integer indicative of an order of discontinuity correction, and where M and N are integers. The M discontinuity-corrected audio signals are indicative of a discontinuity-corrected version of an M-channel mix of audio content of said at least some of the N audio signals.

Figure 10:
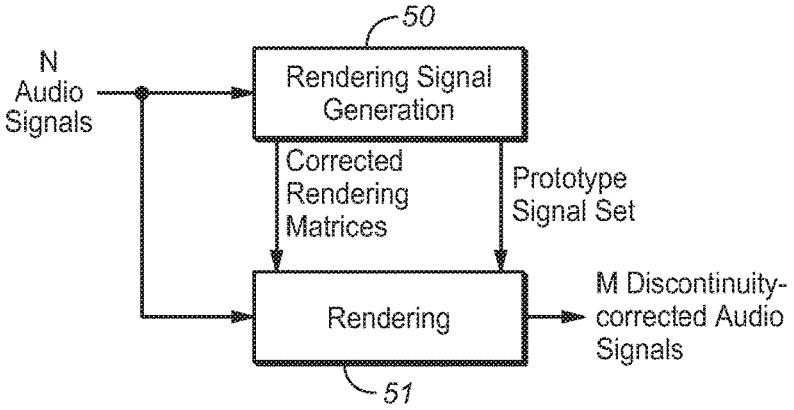
FIG. 10 is a block diagram of an embodiment of the inventive rendering system.

The FIG. 10 system also includes rendering signal generation subsystem 50, which is coupled and configured to generate the discontinuity-corrected rendering matrices in accordance with a sequence of rendering matrices specified for rendering the M-channel mix of audio content of said at least some of the N audio signals, where transitions between matrices of the sequence of rendering matrices occur at update times. Rendering signal generation subsystem 50 is also configured to generate the prototype signal set (which may be of any of the types described herein). Each of the discontinuity-corrected rendering matrices may be an augmented rendering matrix A"(t) of the type described herein with reference to equation (2), and is an augmented version of a corresponding one of the rendering matrices (e.g., a rendering matrix A(t) of the type described herein with reference to equation (1)) which is augmented with correction scaling coefficients. Rendering subsystem is configured to generate the M discontinuity-corrected audio signals by applying the discontinuity-corrected rendering matrices to said at least some of the N audio signals and the prototype signal set, to implement discontinuity correction at said at least one of the update times.

In some implementations of the FIG. 10 system, M is less than N. In other implementations of the FIG. 10 system, M=N, and rendering subsystem 51 is configured to generate N discontinuity-corrected audio signals indicative of an N-channel mix of audio content of the N audio signals, and the sequence of rendering matrices is specified for rendering the audio content of the N audio signals. Typically, rendering signal generation subsystem 50 is configured to determine the correction scaling coefficients such that application of the prototype signal set, scaled by the correction scaling coefficients, to the audio content of said at least some of the N audio signals and the prototype signal set at said at least one of the update times, implements the discontinuity correction at said at least one of the update times.

Another aspect of the invention is an audio rendering method (e.g., one implemented in operation of the FIG. 10 system), including steps of:

(a) in response to N audio signals, generating (e.g., in subsystem 51 of FIG. 10) M discontinuity-corrected audio signals indicative of an M-channel mix of audio content of at least some of the audio signals, in accordance with a sequence of rendering matrices specified for rendering the audio content of said at least some of the N audio signals, where transitions between matrices of the sequence of rendering matrices occur at update times, and where M and N are integers; and (b) determining (e.g., in subsystem 50 of FIG. 10) a prototype signal set of order n, where n is an integer indicative of an order of discontinuity correction, and correction scaling coefficients for application to the audio content of at least some of the N audio signals and the prototype signal set at at least one of the update times to implement discontinuity correction at said at least one of the update times, wherein step (a) includes a step of applying at least some of the correction scaling values to the audio content of said at least some of the N audio signals and the prototype signal set.

The application in step (a) of the correction scaling values to the audio content of at least some of the N audio signals and the prototype signal set may be implemented by performance of matrix multiplication (e.g., in subsystem 51 of FIG. 10) on data indicative of a vector whose elements are a sequence of the N audio signals and the prototype signal set.

In some embodiments, M is less than N. In other embodiments, M=N, and step (a) includes a step of generating N discontinuity-corrected audio signals indicative of an N-channel mix of audio content of the N audio signals, and the sequence of rendering matrices is specified for rendering the audio content of the N audio signals. In some embodiments, step (b) includes a step of determining the correction scaling coefficients such that application (e.g., by subsystem 51 of FIG. 10) of the prototype signal set, scaled by the correction scaling coefficients, to the audio content of said at least some of the N audio signals and the prototype signal set at said at least one of the update times, implements the discontinuity correction at said at least one of the update times.

Embodiments of the invention may be implemented in hardware, firmware, or software, or a combination thereof (e.g., as a programmable logic array). For example, encoder 130 or 230, or decoder 32, or subsystems of any of them, may be implemented in appropriately programmed (or otherwise configured) hardware or firmware, e.g., as a programmed general purpose processor, digital signal processor, or microprocessor. Unless otherwise specified, the algorithms or processes included as part of the invention are not inherently related to any particular computer or other apparatus. In particular, various general-purpose machines may be used with programs written in accordance with the teachings herein, or it may be more convenient to construct more specialized apparatus (e.g., integrated circuits) to perform the required method steps. Thus, the invention may be implemented in one or more computer programs executing on one or more programmable computer systems (e.g., a computer system which implements encoder 130 or 230, or decoder 32, or subsystems of any of them), each comprising at least one processor, at least one data storage system (including volatile and non-volatile memory and/or storage elements), at least one input device or port, and at least one output device or port. Program code is applied to input data to perform the functions described herein and generate output information. The output information is applied to one or more output devices, in known fashion.

Each such program may be implemented in any desired computer language (including machine, assembly, or high level procedural, logical, or object oriented programming languages) to communicate with a computer system. In any case, the language may be a compiled or interpreted language.

For example, when implemented by computer software instruction sequences, various functions and steps of embodiments of the invention may be implemented by multithreaded software instruction sequences running in suitable digital signal processing hardware, in which case the various devices, steps, and functions of the embodiments may correspond to portions of the software instructions.

Each such computer program is preferably stored on or downloaded to a storage media or device (e.g., solid state memory or media, or magnetic or optical media) readable by a general or special purpose programmable computer, for configuring and operating the computer when the storage media or device is read by the computer system to perform the procedures described herein. The inventive system may also be implemented as a computer-readable storage medium, configured with (i.e., storing) a computer program, where the storage medium so configured causes a computer system to operate in a specific and predefined manner to perform the functions described herein.

While implementations have been described by way of example and in terms of exemplary specific embodiments, it is to be understood that implementations of the invention are not limited to the disclosed embodiments. On the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A method for generating an encoded audio program, including steps of:

(a) encoding N audio input signals as N channels of encoded audio content, in accordance with a sequence of rendering matrices specified for rendering audio content of at least some of the N audio input signals, where transitions between matrices of the sequence of rendering matrices occur at update times;

(b) determining an unscaled correction signal set and correction scaling coefficients for scaling the correction signal set, for correcting a discontinuity in audio rendered from the encoded audio program resulting from an update of the rendering matrices, wherein the unscaled correction signal set comprises at least one of a zeroth order correction signal $p_0(t)$ for correcting a zeroth order discontinuity, being a discontinuity in the rendering matrix itself at the time of the update, and a first order correction signal $p_1(t)$ for correcting a first order discontinuity, being a discontinuity in the derivative of the rendering matrix at the time of the update; and (c) generating the encoded audio program to include N channels of discontinuity-corrected, encoded audio content, by adding the correction signal set, scaled by the correction scaling coefficients, to the encoded audio content of at least some of the N channels, wherein step (c) also includes a step of including the correction signal set in the encoded audio program.

2. The method of claim 1, wherein both step (a), and step (c) are implemented by performance of a matrix multiplication on a vector whose elements are a sequence of the N audio input signals and the correction signal set.

3. The method of claim 1, wherein each correction signal of the correction signal set is included as one of the channels of the encoded audio program.

4. The method of claim 1, wherein the sequence of rendering matrices has been specified for rendering at least one mix of audio content of at least some of the N audio input signals, the sequence of rendering matrices determines a sequence of input rendering matrices to be applied by an encoder, and at least one sequence of output rendering matrices to be applied by a decoder.

5. The method of claim 4, wherein the correction scaling coefficients with the sequence of input rendering matrices determine a sequence of augmented input rendering matrices, and step (c) includes a step of applying the augmented input rendering matrices to the N input signals and the correction signal set.

6. The method of claim 1, wherein the audio input signals are indicative of audio objects.

7. A decoder, including:

a memory which stores, in non-transient manner, at least one segment of an encoded audio program which includes N channels of discontinuity-corrected, encoded audio content, and includes data indicative of an output rendering matrix; and a mix generation subsystem coupled and configured to mix samples of the discontinuity-corrected, encoded audio content, including by applying to the samples said data indicative of the output rendering matrix, to generate an M-channel mix of at least some of the discontinuity-corrected, encoded audio content, where a sequence of rendering matrices has been specified for rendering the M-channel mix, where transitions between matrices of the sequence of rendering matrices occur at update times, where N and M are integers, and wherein the N channels of discontinuity-corrected, encoded audio content have been generated by applying discontinuity correction values to N channels of audio content to implement discontinuity correction at at least one of the update times.

8. The decoder of claim 7, wherein N≥M.

9. The decoder of claim 7, wherein the encoded audio program includes data indicative of at least some of the discontinuity correction values, the output rendering matrix is an augmented version of an M×M matrix, and the mix generation subsystem is configured to mix the samples including by applying to said samples, and to at least some of the discontinuity correction values, said data indicative of the output rendering matrix.

10. The decoder of claim 7, wherein the N channels of audio content are indicative of N audio objects, and the M-channel mix is a discontinuity-corrected mix of audio object content.

11. An audio encoder configured to generate an encoded audio program, said encoder including:

a first subsystem coupled and configured to encode N audio input signals as N channels of encoded audio content, in accordance with a sequence of rendering matrices specified for rendering audio content of at least some of the N audio input signals, where transitions between matrices of the sequence of rendering matrices occur at update times; and a second subsystem, coupled to the first subsystem, and configured to determine an unscaled correction signal set and correction scaling coefficients for scaling the correction signal set, for correcting a discontinuity in audio rendered from the encoded audio program resulting from an update of the rendering matrices, wherein the unscaled correction signal set comprises at least one of a zeroth order correction signal $p_0(t)$ for correction a zeroth order discontinuity, being a discontinuity in the rendering matrix itself at the time of the update, and a first order correction signal $p_1(t)$ for correcting a first order discontinuity, being a discontinuity in the derivative of the rendering matrix at the time of the update, wherein the first subsystem is configured to generate the encoded audio program to include N channels of discontinuity-corrected, encoded audio content, by adding the correction signal set, scaled by the correction scaling coefficients to the encoded audio content of at least some of the N channels wherein the encoder is further configured to include the correction signal set in the encoded audio program.

12. The encoder of claim 11, wherein the first subsystem is configured to encode the N audio input signals as the N channels of encoded audio content, and to generate the encoded audio program by performing a matrix multiplication on a vector whose elements are a sequence of the N audio input signals and the correction signal set.

13. The method of claim 4, further comprising including, in the encoded audio program, the at least one sequence of output rendering matrices to be applied by a decoder.

14. The method of claim 4, wherein the sequence of rendering matrices determines a plurality of sequences of output rendering matrices to be applied by a decoder.

15. The method of claim 4, wherein the at least one sequence of output rendering matrices to be applied by a decoder comprises a sequence of M×M output rendering matrices to be applied to an M-channel subset of the N channels of discontinuity-corrected, encoded audio content to generate an M-channel mix of the N audio input signals.

16. The method of claim 15, wherein the N audio input signals are indicative of N audio objects, and the M-channel mix is a discontinuity-corrected mix of audio object content.

17. The method of claim 4, wherein the at least one sequence of output rendering matrices to be applied by a decoder comprises a sequence of (N+1)×(N+1) output rendering matrices to be applied to the N channels of discontinuity-corrected, encoded audio content and the correction signal set to losslessly reconstruct the N audio input signals.

18. The decoder of claim 7, wherein N =M, and the M-channel mix of at least some of the discontinuity-corrected, encoded audio content is a lossless reconstruction of the N channels of audio content.

19. The decoder of claim 18, wherein the encoded audio program includes data indicative of at least some of the discontinuity correction values, the data indicative of the output rendering matrix corresponds to coefficients of a sequence of (N+1)×(N+1) matrices, and the lossless reconstruction of the N channels of audio content is generated by applying the sequence of (N+1)×(N+1) matrices to the samples of the discontinuity-corrected, encoded audio content and to at least some of the discontinuity correction values.

20. The decoder of claim 7, wherein M is less than N, the data indicative of the output rendering matrix corresponds to coefficients of a sequence of M×M matrices, and generating the M-channel mix comprises applying the sequence of M×M matrices to samples of an M-channel subset of the N channels of discontinuity-corrected, encoded audio content.

* * * * *